US006550161B2

(12) United States Patent
Hanafusa et al.

(10) Patent No.: US 6,550,161 B2
(45) Date of Patent: Apr. 22, 2003

(54) WALK BEHIND SELF-PROPELLED CRAWLER SNOWPLOW

(75) Inventors: Jitsumi Hanafusa, Wako (JP); Kenji Kuroiwa, Wako (JP)

(73) Assignee: Honda Giken Kogyo Kabushiki Kaisha (JP)

( * ) Notice: Subject to any disclaimer, the term of this patent is extended or adjusted under 35 U.S.C. 154(b) by 0 days.

(21) Appl. No.: 10/127,218

(22) Filed: Apr. 19, 2002

(65) Prior Publication Data

US 2002/0152647 A1 Oct. 24, 2002

(30) Foreign Application Priority Data

| | | |
|---|---|---|
| Apr. 20, 2001 | (JP) | 2001-123282 |
| Sep. 14, 2001 | (JP) | 2001-280148 |
| Sep. 19, 2001 | (JP) | 2001-285690 |
| Oct. 30, 2001 | (JP) | 2001-333248 |

(51) Int. Cl.[7] ..... E01H 5/09

(52) U.S. Cl. ..... 37/246; 37/257; 192/3.58; 192/56.4; 192/54.4

(58) Field of Search ..... 37/244, 246, 248, 37/251–257, 245, 249, 266; 56/11.3, 10.8, 11.4, 11.5, 11.7; 180/65.6; 192/34, 3.58, 3.57, 3.54, 3.51, 56.4, 54.4

(56) References Cited

FOREIGN PATENT DOCUMENTS

| | | |
|---|---|---|
| JP | 63223207 | 9/1988 |
| JP | 01163304 | 6/1989 |
| JP | 01038681 | 11/1989 |
| JP | 02038606 | 2/1990 |
| JP | 03107009 | 5/1991 |
| JP | 09114535 | 5/1997 |

*Primary Examiner*—Christopher J. Novosad
(74) *Attorney, Agent, or Firm*—Adams & Wilks

(57) ABSTRACT

A walk behind self-propelled crawler has a travel ready lever mounted to one of the left and right handlebars and adapted to be gripped by a human operator to place the electric motors in an operative condition, and a clutch control pushbutton switch disposed on the control board at a position close to the other handlebar, the clutch control pushbutton switch being adapted to be manually operated to actuate the electromagnetic clutch.

11 Claims, 21 Drawing Sheets

WALK BEHIND SELF-PROPELLED CRAWLER SNOWPLOW

FIELD OF THE INVENTION

The present invention relates to a walk behind self-propelled crawler snowplow having driving wheels mounted on a vehicle body for driving the snowplow, an auger for removing snow, and left and right handlebars extending from a rear end of the vehicle body in a rearward direction of the snowplow.

BACKGROUND OF THE INVENTION

Walk behind self-propelled crawler snowplows are known from Japanese Patent Laid-open Publications Nos. (SHO) 63-223207, (HEI) 02-38606 and (HEI) 03-107009. The known snowplows have left and right operation handlebars extending from a rear end of a vehicle body, and a snow-removing mechanism including an auger and a blower that are mounted on a front portion of the vehicle body. During snow-removing operation, the auger and the blower are driven while the handlebars are properly manipulated to keeping a desired traveling posture of the snowplow. In general, the snowplows have various operation control levers that are manipulated to control travel conditions of the vehicle body and drive conditions of the auger and blower. A typical example of the conventional operation control levers will be described in greater detail with reference to FIGS. 20A and 20B.

As shown in FIGS. 20A and 20B, left and right operation handlebars 100L and 100R extending from a rear portion of the vehicle body (not shown) each have a grip 101L, 101R. A travel control lever 102 is pivotally mounted via a bracket 102*a* to the left handlebar 100L in the proximity of the grip 101L. An auger control lever 103 is pivotally mounted via a bracket 103*a* to the right handlebar 101R in the proximity of the grip 101R.

In operation of the snowplow, the travel control lever 102 is manually operated to swing in a direction indicated by the arrow shown in FIG. 20A. By thus swinging the travel control lever 102, a power transmission belt associated with a travel clutch (neither shown) for actuating the same is stretched or tensioned to thereby place the travel clutch in the engaged condition or state. The travel clutch enables power to be transmitted to driving wheels (not shown).

The auger control lever 103 is manually operated to swing in a direction indicated by the arrow shown in FIG. 20B. With this angular movement of the auger control lever 103, a power transmission belt associated with an auger clutch (neither shown) for actuating the same is stretched or tensioned to thereby place the auger clutch in the engaged state. The auger clutch enables power to be transmitted to an auger (not shown).

To keep the travel control lever 102 in its operating position, it is necessary for the human operator to continue gripping of the travel control lever 102 using its left hand. However, due to a great force required to tension the power transmission belt to actuate the travel clutch, continued gripping of the travel control lever 102 means that a great force F (FIG. 20B) must be continuously applied to the travel control lever 102 so as to keep the lever in its operating position. With this requirement, the left hand of the human operator is subjected to undue load when the snow-removing operation continues for a long time. A similar problem occurs when the auger control lever is operated with the right hand of the operator so as to keep the engaged state of the auger clutch.

FIG. 21 shows another example of the conventional operation control levers, which is disclosed in Japanese Patent Laid-open Publication No. (HEI) 02-38606. As shown in this figure, a travel control lever 102 mounted to the left handlebar 100L and an auger control lever 103 mounted to the right handlebar 100R are connected together by a connecting mechanism 105. The connecting mechanism 105 is arranged such that when the auger control lever 103 is operated to swing toward an operating position while the travel control lever 102 is held in its operating position, a locking cam (not shown) of the connecting mechanism 105 engages the auger control lever 103 to thereby lock the lever 103 in the operating position.

So long as the operator continues gripping of the travel control lever 102 to maintain a force F exerted on the lever 102, the auger control lever 103 is held in its operating position even when the operator releases the lever 103. The right hand of the operator is thus freed from the auger lever handling work and is able to undertake manipulation of other levers and switches. This may increase the working efficiency of the snowplow.

The connecting mechanism 105, which is provided to lock the auger control lever 103 in its operating position while allowing the operator to release the same lever, gives rise to a problem that the snowplow is rendered complicated in construction and costly to manufacture. Additionally, due to the structural complexity, the snowplow requires much labor for maintenance.

SUMMARY OF THE INVENTION

It is accordingly an object of the present invention to provide a walk behind self-propelled crawler snowplow, which can be maneuvered with reduced labor, is relatively simple in construction and can be manufactured less costly.

According to the present invention, there is provided a walk behind self-propelled snowplow comprising: a vehicle body; at least one driving wheel mounted on the vehicle body for propelling the snowplow; a first power transmitting mechanism; an electric motor that drives the driving wheel via the first power transmission mechanism; a snow-removing auger mounted on the vehicle body; a second power transmission mechanism; a power source that drives the auger via the second power transmission mechanism; an electromagnetic clutch incorporated in the second power transmission mechanism for the connection and disconnection of the power source and the auger; left and right handlebars extending from a rear end of the vehicle body in a rearward direction of the snowplow; a control board disposed between the left and right handlebars; a travel ready lever mounted to one of the left and right handlebars and adapted to be gripped by a human operator to place the electric motor in an operative condition; and a clutch control pushbutton switch disposed on the control board at a position close to the other handlebar, the clutch control pushbutton switch being adapted to be manually operated to actuate the electromagnetic clutch.

Use of the travel ready lever and the clutch control pushbutton switch in combination enables the operator to maneuver the snowplow with reduced labor, makes the snowplow relatively simple in construction.

In one preferred form of the invention, the first power transmission mechanism includes an electromagnetic brake, and the travel ready lever comprises a brake control lever operatively connected to the electromagnetic brake in such a manner that when the brake control lever and the one handlebar are gripped together by the human operator, the electromagnetic brake is released to thereby allow power from the electric motor to be transmitted to the driving wheel.

The snowplow may further include a brake control switch operatively connected to the electromagnetic brake. The brake control switch is adapted to be actuated by the brake control lever to disengage the electromagnetic brake when the brake control lever and the one handlebar are gripped together by the human operator. Preferably, the clutch control pushbutton switch is connected to a power supply via the brake control switch.

It is preferable that the clutch control pushbutton switch and the travel ready lever are operationally linked with each other. The snowplow may further include a travel ready switch adapted to be actuated by the travel ready lever to place the electric motor in the operative condition, the clutch control pushbutton switch being electrically connected with the ravel ready switch. In another preferred form of the invention, the electromagnetic clutch and the travel ready lever are operatively connected together via the travel ready switch and the clutch control pushbutton switch in such a manner that the electromagnetic clutch is engaged and disengaged when the clutch control pushbutton switch is actuated while the travel ready lever is being gripped together with the one handlebar, the electromagnetic clutch is forcibly disengaged when griping of the travel ready lever is released after the clutch control pushbutton switch is actuated to engage the electromagnetic clutch, and the electromagnetic clutch is engaged and disengaged when clutch control pushbutton switch is actuated while the travel ready lever is released.

In a further preferred form of the invention, the snowplow further include a travel ready switch adapted to be actuated by the travel ready lever to place the electric motor in the operative condition, and a U-shaped bracket attached to the one handlebar so as to define therebetween a hollow space. The travel ready switch has a switch body received in the hollow space of the U-shaped bracket and attached to the bracket, an actuator retractably mounted on the switch body and projecting outward from an open end of the U-shaped bracket. The travel ready lever has a pusher part normally held in abutment with the open end of the bracket and closing the open end of the bracket while forcing the actuator of the travel ready switch in a retracted position. The pusher part is displaced away from the open end of the bracket to thereby allow the actuator of the travel ready switch to project outward from the open end of the bracket when the travel ready lever is gripped. The pusher part of the travel ready lever may be integral with a body of the travel ready lever. Alternatively, the travel ready lever may be composed of a lever body and a pusher member pivotally connected with the lever body, the pusher member forming the pusher part. The lever body has an engagement portion normally spaced from the pusher member, the engagement member being engaged with the pusher member to pivot relative to the lever body in a direction away from the open end of the bracket as the lever body approaches the one lever. The open end of the bracket forms a stopper engageable with a part of the travel ready lever to limit a range of pivotal movement of the travel ready lever.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION OF THE PREFERRED EMBODIMENTS

The following description is merely exemplary in nature and is in no way intended to limit the invention or its application or use.

Figure 1:
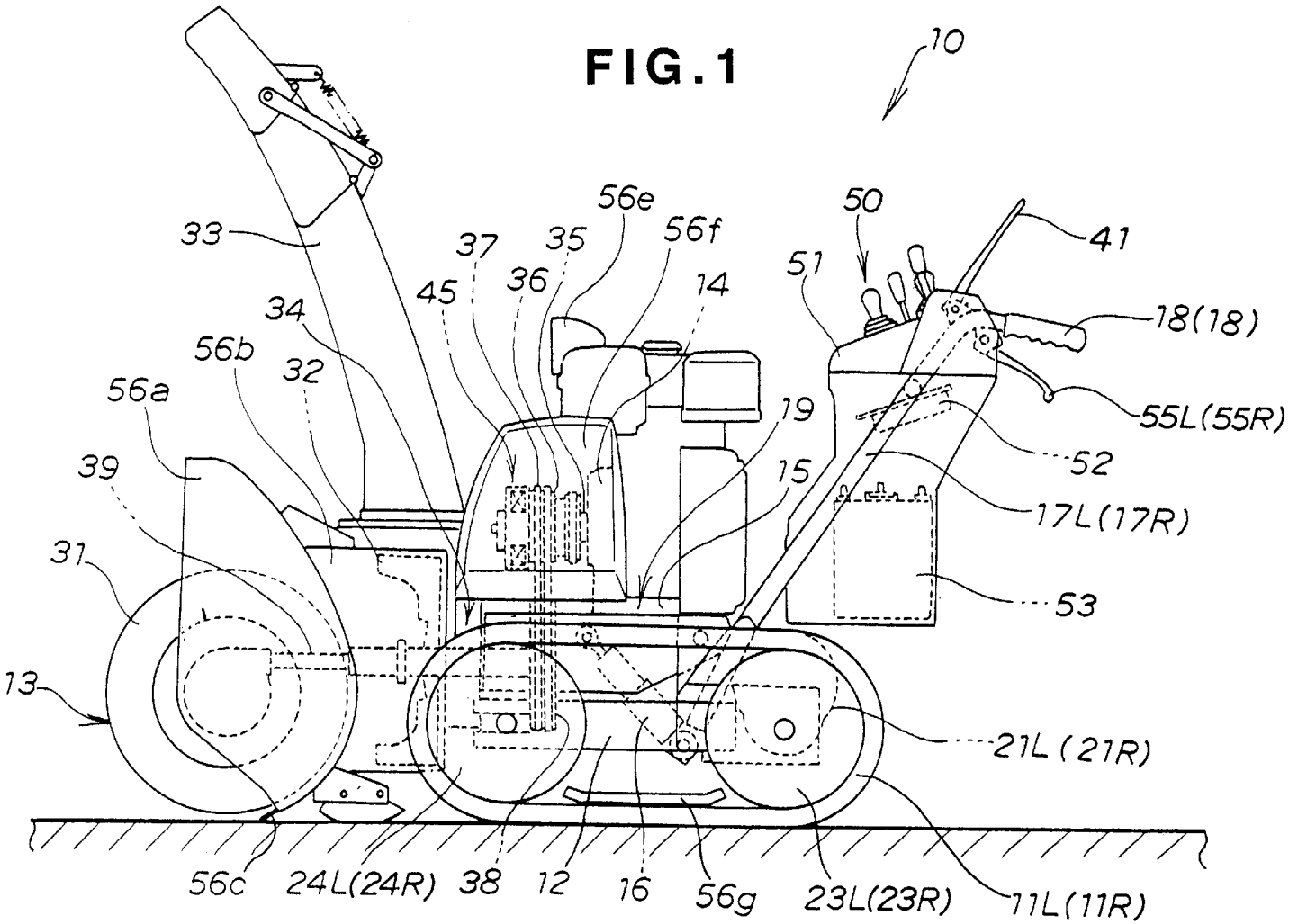
FIG. 1 is a left side view of a walk behind self-propelled crawler snowplow according to an embodiment of the present invention.

Referring to the drawings and FIG. 1 in particular, there is shown a walk behind self-propelled crawler snowplow 10 according to an embodiment of the present invention. The snowplow 10 generally comprises a propelling frame 12 carrying thereon left and right crawler belts (only the left crawler belt 11L being shown), a vehicle frame 15 carrying thereon a snowplow mechanism 13 and an engine (prime motor) 14 for driving the snowplow mechanism 13, a frame lift mechanism 16 operable to lift a front end portion of the vehicle frame 15 up and down relative to the propelling frame 12, and a pair of left and right operation handlebars 17L and 17R extending from a rear portion of the propelling frame 12 obliquely upward in a rearward direction of the snowplow 10. The propelling frame 12 and the vehicle frame 15 jointly form a vehicle body 19.

The operation handlebars 17L, 17R are adapted to be gripped by a human operator (not shown) walking behind the snowplow 10 in order to maneuver the snowplow 10. A control board 51, a control unit 52 and batteries 53 are arranged in a vertical space defined between the handlebars 17L, 17R and they are mounted to the handlebars 17L, 17R in the order named when viewed from the top to the bottom of FIG. 1.

The operation handlebars 17L, 17R each have a grip 18 at the distal end (free end) thereof. The left handlebar 17L has a travel ready lever 41 disposed in the proximity of a grip 18 for easy manipulation by the human operator. The control board 51 has a pushbutton 47 (FIG. 2) disposed near the right handlebar 17R. The left and right handlebars 17L, 17R further have turn control levers 55L, 55R disposed in the proximity of the respective grips 18, 18.

The crawler snowplow 10 is arranged such that power from an output shaft (crankshaft) 35 of the engine 14 can be transmitted via a driving pulley 36 and a power transmission belt 37 to the snowplow mechanism 13. To this end, an electromagnetic clutch 45 is mounted on the output shaft 35. The driving pulley 36 is freely rotatably mounted on the output shaft 35 of the engine 14 and is connected with the output shaft 35 when the electromagnetic clutch 45 is actuated or placed in the engaged state.

The snowplow mechanism 13 has an auger 31, a blower 32 and a discharge duct or shooter 33 that are mounted to a front portion of the vehicle frame 15. The auger 31 and the blower 32 are rotatably mounted on a rotating shaft 39. The rotating shaft 39 has a driven pulley 38 connected in driven relation to the driving pulley 36 via the power transmission belt 37.

In operation, the power from the engine output shaft 35 is transmitted via the electromagnetic clutch 45 to the driving pulley 36, and rotation of the driving pulley 36 is transmitted via the power transmission belt 37 to the driven pulley 38. With this rotation of the driven pulley 35, the rotating shaft 39 concurrently rotates the auger 31 and the blower 32. The auger 31 cuts snow away from a road, for example, and feeds the snow into the blower 32. The blower 32 blows out the snow through the discharge duct 33 to a distant place.

In FIG. 1 reference numeral 56*a* denotes an auger case, numeral 51*b* denotes a blower case, numeral 56*c* denotes a scraper formed integrally with a lower edge of the auger case 56*a*, numeral 56*d* (FIG. 2) denotes a charging generator for charging the batteries 53, numeral 56*e* denotes a lamp, numeral 56*f* denotes a cover for protecting the generator 56*d* and the electromagnetic clutch 45, and numeral 56*g* denotes a stabilizer for urging each crawler belt 11L, 11R downward against the ground surface.

Figure 2:
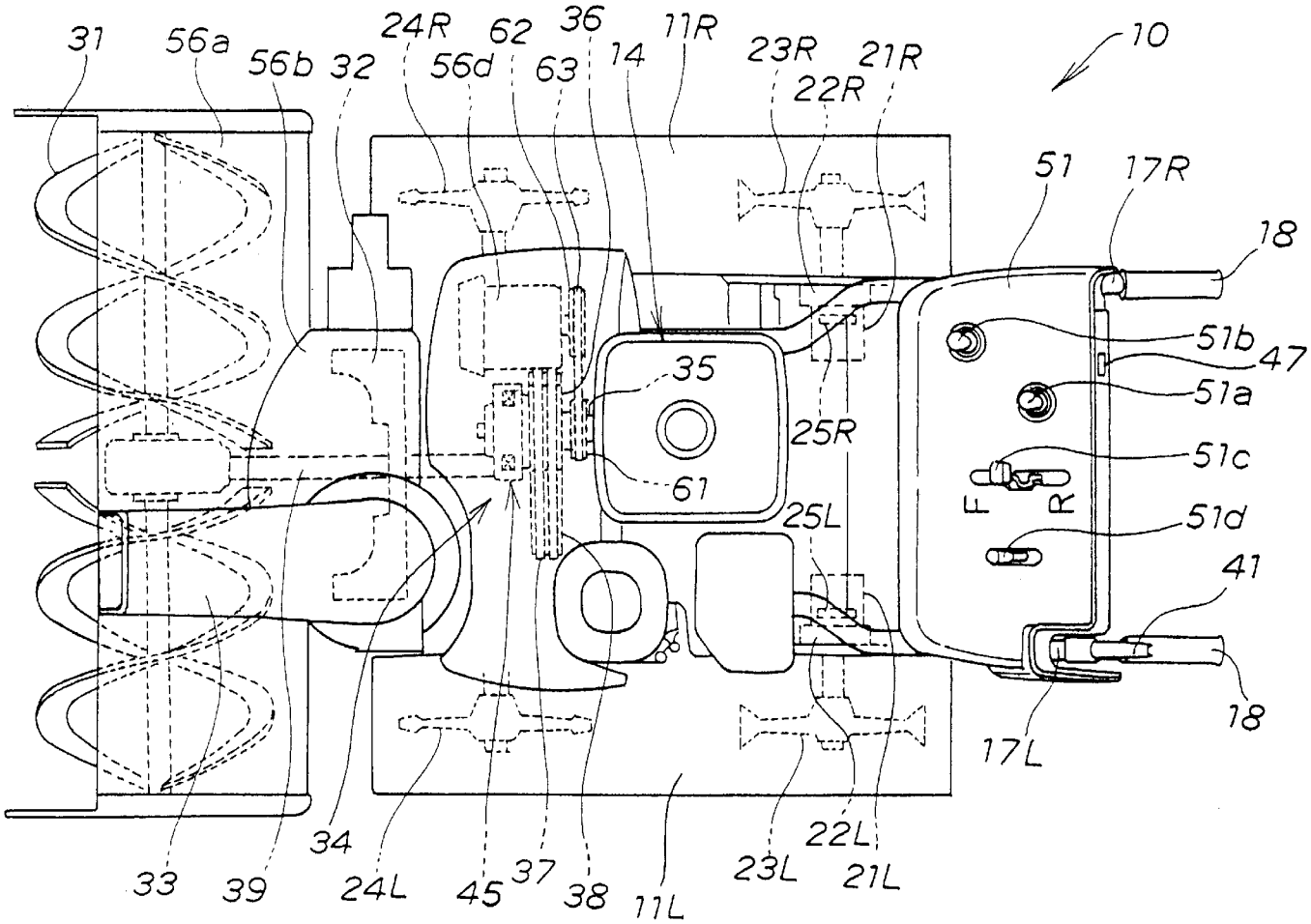
FIG. 2 is a plan view of the crawler snowplow.

As shown in FIG. 2, the left and right crawler belts 11L, 11R are driven by left and right electric motors 21L, 21R, respectively. The crawler belts 11L, 11R are each trained around a driving wheel 23L, 23R and an idler wheel 24L, 24R. The driving wheel 23L, 23R is disposed on a rear side of the crawler belt 11L, 11R, and the idler wheel 24L, 24R is disposed on a front side of the crawler belt 11L, 11R. The crawler snowplow 10 of the foregoing construction is self-propelled by the crawler belts 11L, 11R driven by the electric motors 21L, 21R and is also maneuvered by the human operator walking behind the snowplow 10 while handling the handlebars 17L, 17R.

In order to drive the charging generator 56*d*, a generator driving pulley 61 is mounted to the engine output shaft 35, and a generator driven pulley 62 is mounted to a shaft of the generator 56*d*. The driving and driven pulleys 61, 62 are connected by a V-belt 63, so that rotation of the engine output shaft 35 is transmitted to the charging generator 56*d*.

The control board 51 has a lift control lever 51*a* for controlling operation of the frame lift mechanism 16 (FIG. 1), a shooter control lever 51*b* for changing the direction of the shooter 33, a forward/reverse speed control lever 51*c* for adjusting the forward/reverse speed of the crawler snowplow 10, and a throttle lever 51*d* for controlling rotational speed of the engine 14. The forward/reverse speed control lever 51*c* has a function to reverse the direction of rotation of the electric motors 21L, 21R so as to change or shift the direction of travel of the crawler snowplow between the forward direction and the reverse direction.

Figure 3:
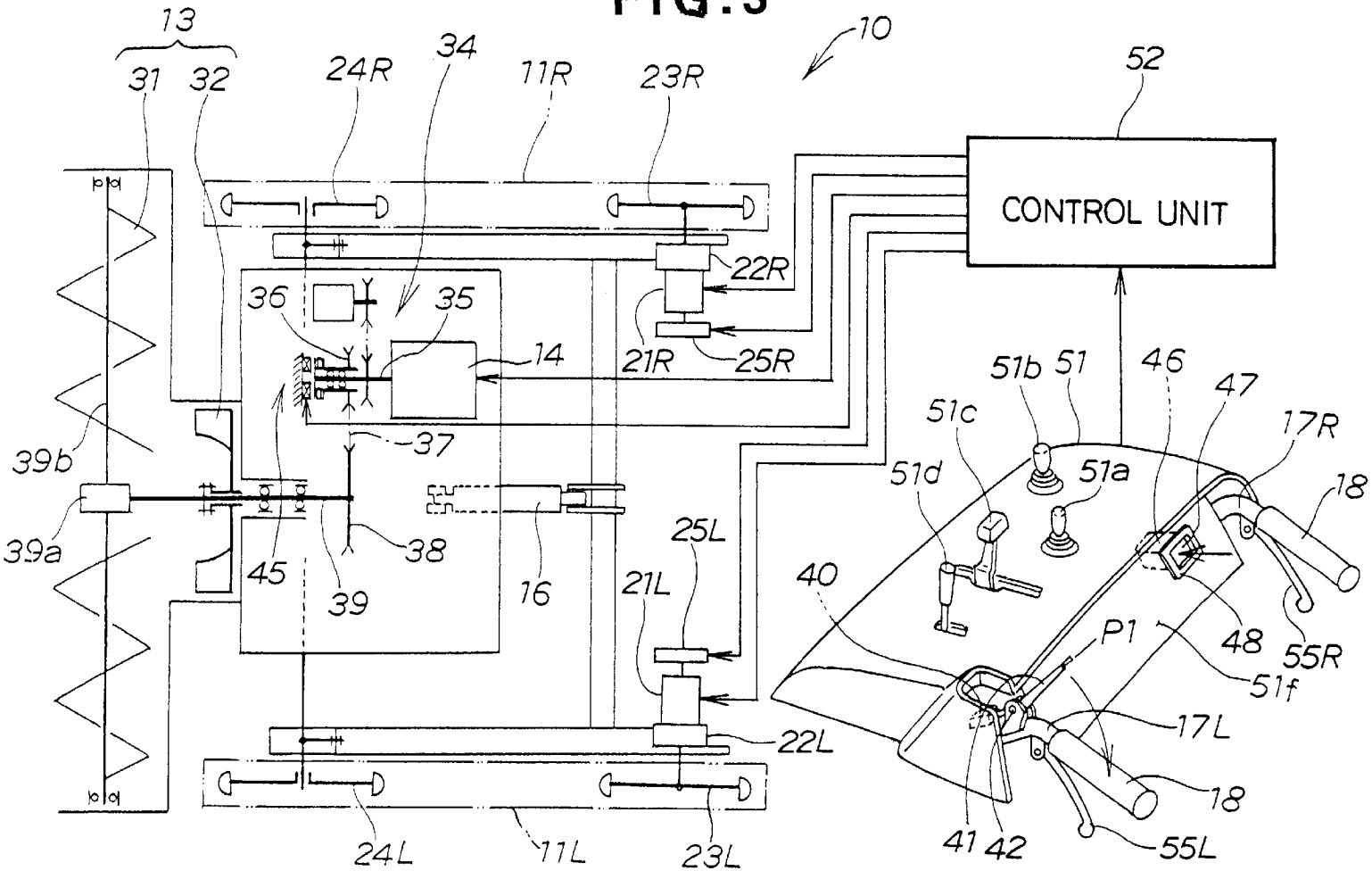
FIG. 3 is a diagrammatical view showing the operational relationship between an operation control part and drive mechanisms of the crawler snowplow.

As better shown in FIG. 3, power from each electric motor 21L, 21R is transmitted via a speed reducer 22L, 22R to the corresponding driving wheel 23L, 23R to thereby drive the associated crawler belt 11L, 11R. The speed reducer 22L, 22R forms a power transmission mechanism and is equipped with an electromagnetic brake 25L, 25R.

The travel ready lever 41 is pivotally connected by a pin 42 to a bracket (not designated) attached to the left handlebar 17L. This lever 41 is manually operated to place the crawler snowplow 10 in a condition ready for traveling and snow-removing operation. A travel ready switch 40 is disposed close to the travel ready lever 41 for activation and de-activation by the lever 41. The switch 40 is electrically connected with the control unit 52 so that the position of the travel ready lever 41 can be represented by the ON-OFF state of the travel ready switch 40.

The travel ready lever 41 is normally disposed in an inclined inoperating position P1 shown in FIG. 3. When gripped with the left hand of the operator, the travel ready lever 41 is placed in a recumbent operating position where the lever 41 lies flat on the grip 18. When released from the operator's left hand, the travel ready lever 41 automatically returns to the original in operating position P1 by the force of a return spring (not shown in FIG. 3). The stroke of pivotal movement of the travel ready lever 41 is set to be sufficiently large so that the foregoing travel ready condition of the snowplow 10 does not occur unless the travel ready lever 41 is pressed deeper to assume the operating position where the lever 41 lies flat on the grip 18 of the left handlebar 17L. This arrangement increases the operational reliability of the travel ready lever 41.

When the travel ready lever 41 reaches the recumbent operating position, the travel ready switch 40 is turned on and an electric signal indicative of the arrival of the lever 41 at the operating position is supplied from the switch 40 to the control unit 52. Upon receipt of the electric signal, the control unit 52 places the crawler snowplow 10 in the aforesaid condition ready for traveling and snow-removing operation. The structure and operation of the travel ready lever 41 will be described in detail with reference to FIGS. 10 to 12.

The travel ready lever 41 is disposed generally above the travel ready switch 40 so that the switch 40 is protected against unintentional access tending to turn on or off the switch 40.

While the engine 14 is operating, power from the engine 14 can be transmitted via a power transmission mechanism 34 to the snowplow mechanism 13. The power transmission mechanism 34 includes the driving pulley 36 mounted on the output shaft 35 of the engine 14 via the electromagnetic clutch 45, the driven pulley 38 mounted to the rotating shaft 39, the power transmission belt 37 connecting the driving and driven pulleys 36 and 38, a worm gear speed-reducing mechanism 39*a* interconnecting the rotating shaft 39 and an auger shaft 39*b*. The rotating shaft 39 is connected to the blower 32, and the auger shaft 39*b* forms a part of the auger 31.

The pushbutton 47 that is provided on the control board 51 at a position close to the right handlebar 17R for activation and deactivation of the electromagnetic clutch 45 forms a part of a clutch control switch 46. Thus, the clutch control switch 46 comprises a pushbutton switch. The clutch control pushbutton switch 46 is mounted on a rear end portion 51*f* of the control board 51 and located close to the right handlebar 17R.

The pushbutton 47 of the pushbutton switch 46 is normally disposed in an in operating position shown in FIG. 3. When depressed by the operator using a finger of the right hand, the pushbutton 47 is temporarily locked in a depressed operating position. When the operator pushes the pushbutton 47 again, the pushbutton 47 is released and automatically returns to the original inoperating position by the force of a return spring (not shown in FIG. 3). The clutch control pushbutton switch 46 may have a built-in lamp, such as a backup lamp, which facilitates visual observation of the clutch control pushbutton switch 46 in the dark or during snowfall.

When the operator pushes the pushbutton 47 down to the operating position by using its right hand finger, the clutch control pushbutton switch (hereinafter referred to, for brevity, as "clutch switch") 46 is turned on and sends an electric signal to the control unit 52, which in turn generates a command signal to engage the electromagnetic clutch 45. The electromagnetic clutch 45 is thus activated, and rotation of the engine output shaft 35 is transmitted via the electromagnetic clutch 45 to the snowplow mechanism 13, thereby rotating the auger 31 and the blower 32.

The pushbutton 47 is surrounded by a guard 48 that is attached to the rear end portion 51*f* of the control board 51 so as to protect or guard the pushbutton 47 against unintentional access tending to turn on or off the clutch switch 46.

Figure 4:
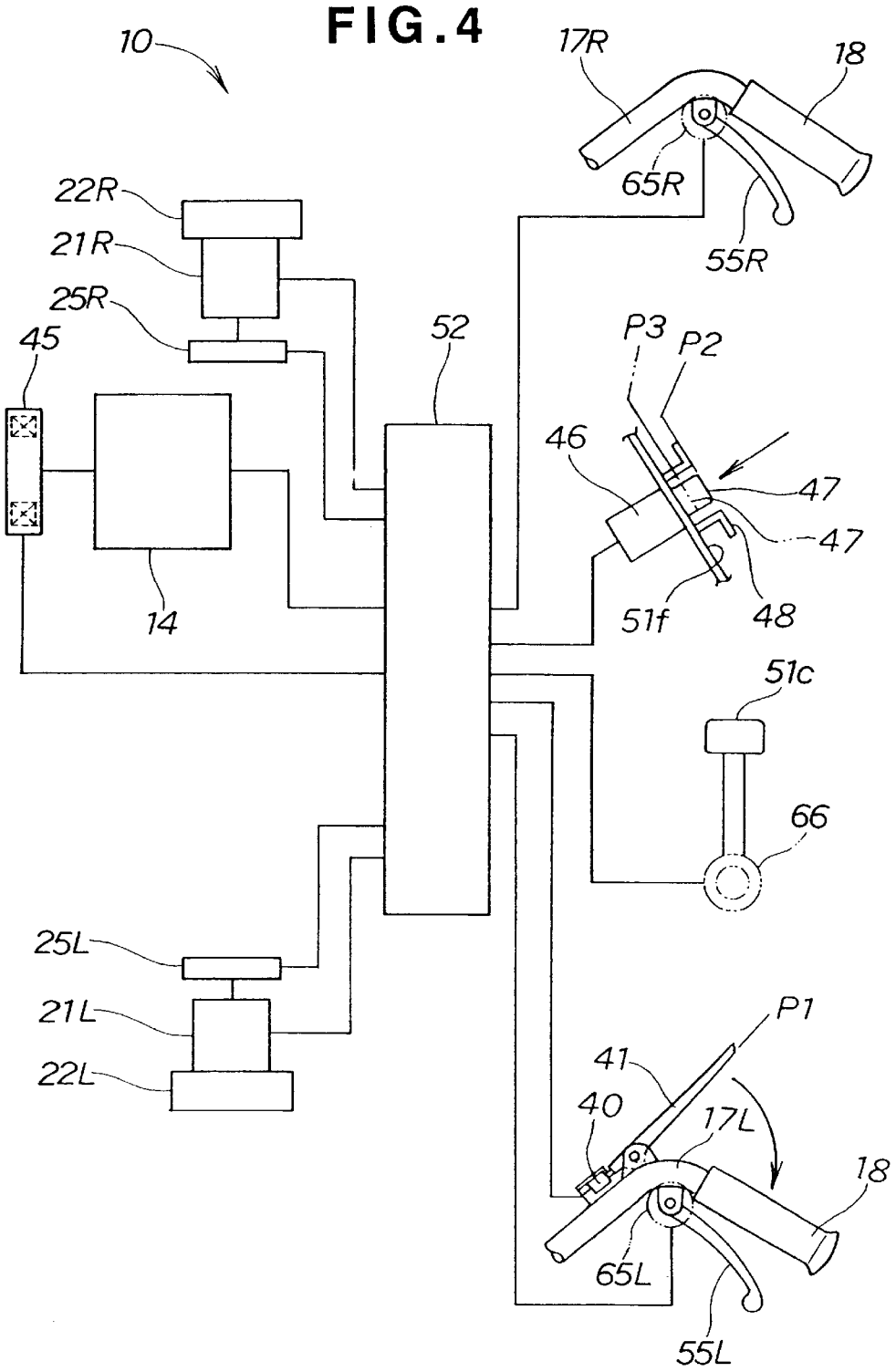
FIG. 4 is a diagrammatical view showing an arrangement for controlling the operation of crawler driving motors and an auger clutch.

The left and right turn control levers 55L, 55R are connected with potentiometers 65L, 65R (FIG. 4). When each of the turn control levers 55L, 55R and the grip 18 of the associated handlebar 17L, 17R are gripped together, the potentiometer 65L, 65R changes its voltage value whereupon a regenerative braking force is applied to the corresponding electric motor 21L, 21R under the control of the control unit 52. By the effect of the regenerative braking force, the rotational speed (number of revolutions per unit time) of the electric motor 21L, 21R is slowed down to thereby turn the vehicle body 19 (FIG. 1) in a leftward or a rightward direction.

The forward/reverse speed control lever 51*c* is also connected to a potentiometer 66 (FIG. 4). This lever 51*c* is normally disposed in the upright neutral position shown in FIG. 3, where the control units 52 generates a command signal to stop traveling of the crawler snowplow 10. When the control lever 51*c* is tilted down in a forward direction of the crawler snowplow 10, the control unit 52 generates a command signal to move the crawler snowplow in the forward direction at a speed corresponding to the amount of angular displacement of the lever 55*c* from the neutral position. Similarly, when the control lever 51*c* is tilted down in the rearward direction of the crawler snowplow 10, the control unit 52 generates a command signal to move the crawler snowplow 10 backward at a speed corresponding to the amount of angular displacement of the lever 51*c* from the neutral position. The potentiometer 66 is designed to vary the voltage value in proportion to the amount of angular displacement of the control lever 51*c* from the neutral position.

Operation of the crawler snowplow 10 will be described with reference to FIG. 4. The travel ready lever 41 is normally disposed in the inclined inoperating position P1. When gripped with the operator's left hand together with the left grip 18, the travel ready lever 41 is angularly moved from the inoperating position P1 to the recumbent operating position where the lever 41 lies flat on the left grip 18. When the travel ready lever 41 reaches the recumbent operating position, the travel ready switch 40 is turned on or activated whereupon an electric signal indicative of the arrival of the travel ready lever 41 at the operating position is supplied to the control unit 52. The control unit 52 operates to place the crawler snowplow 10 in a condition ready for travel and snow-removing operation, allowing the electric motors 21L, 21R and auger 31 to rotate. In this instance, since the travel ready lever 41 has a large swing stroke, it is possible to keep the travel ready switch 40 in the off state until the travel ready lever 41 arrives at its operating position. With this arrangement, unintentional activation or deactivation of the travel ready switch 40 does not occur, and the reliability in operation of the travel ready lever 41 increases. When the travel ready lever 41 is released, rotation of the auger 31 and running of the crawler snowplow 10 are stopped.

While gripping the travel ready lever 41 with its left hand, the operator depresses the pushbutton 47 using a finger of the right hand until the pushbutton 47 assumes the operating position P3. With this depression of the pushbutton 47, the clutch switch 46 is turned on whereupon an electric signal pulse is supplied from the switch 46 to the control unit 52, which in turn generates a command signal to actuate or engage the electromagnetic clutch 45. When the pushbutton 47 is depressed again, the clutch switch 46 is turned off and a signal pulse is supplied from the switch 36 to the control unit 52. The control unit 52 in turn generates a command signal to disengage the electromagnetic clutch 45.

While keeping a grip on the travel ready lever 41, the operator further grips the left and right turn control levers 55L, 55R to thereby vary the voltage values of the potentiometers 65L, 65R. variations of the voltage value are read in the control unit 52, which in turns operates to apply regenerative braking forces to the electric motors 21L, 21R to thereby change the rotating speeds of the electric motors 21L, 21R. By properly adjusting the amount of angular displacement of the speed control levers 55L, 55R (corresponding to the magnitude of regenerative braking forces on the electric motors 21L, 21R), it is possible to turn the crawler snowplow 10 in a desired direction with a desired radius of curvature.

The control unit 52 may have a diagnostic function to detect and isolate a malfunction or a failure in the crawler snowplow on the basis of signals supplied from the travel ready switch 40 and the clutch switch 45. This will increase the maintainability of the crawler snowplow.

Figure 5:
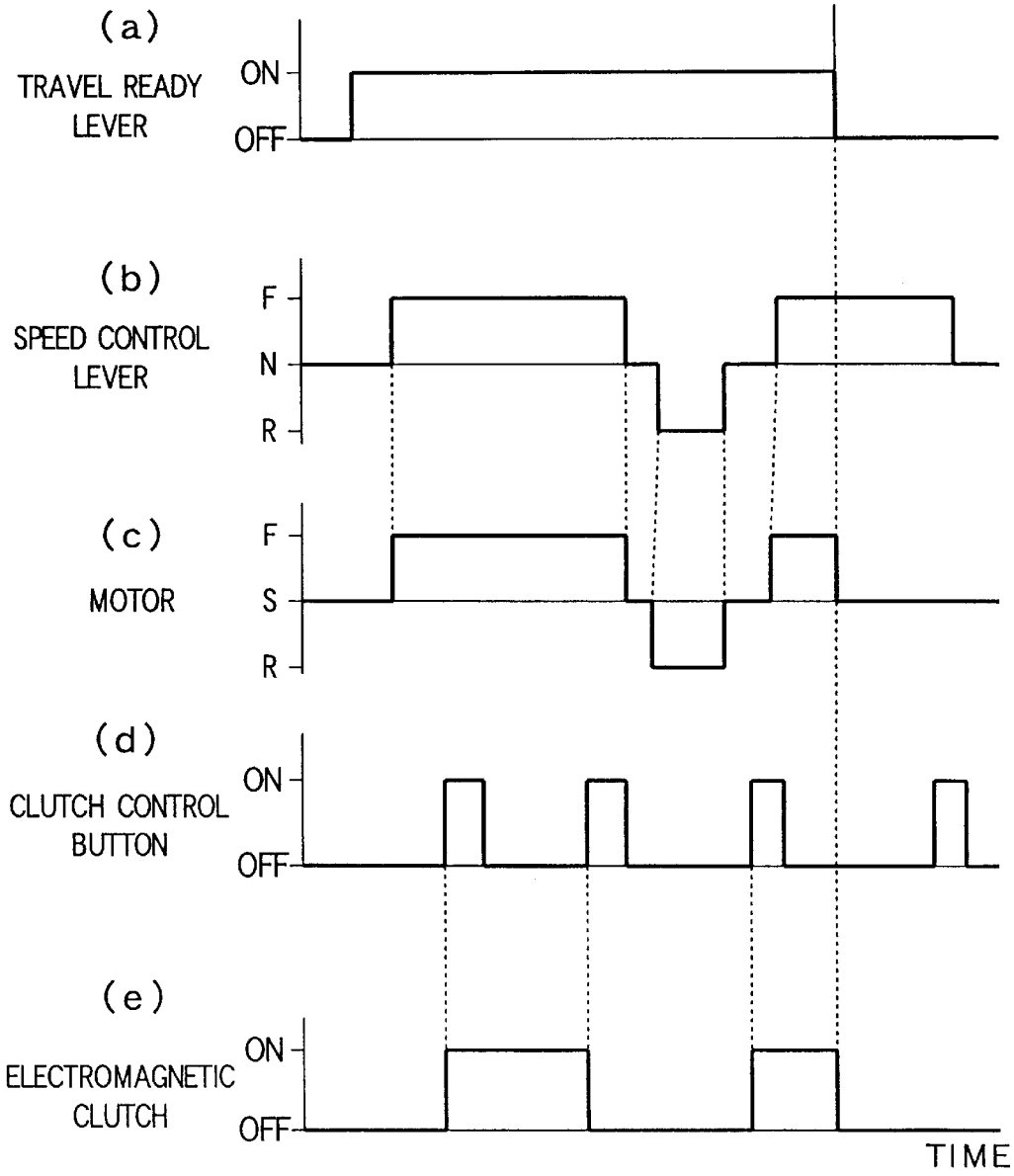
FIG. 5 is a time chart illustrative of the operation of the arrangement shown in FIG. 4.

FIG. 5 is a time chart illustrative of operation of the crawler snowplow 10. In (a) of FIG. 5, the vertical axis represents the position of the travel ready lever 41 corresponding to the state of the travel ready switch 40, and the horizontal axis represents the time. Similarly in (b) of FIG. 5, the vertical axis represents the position of the forward/reverse speed control lever 51*c*, and the horizontal axis represents the time. In (c) of FIG. 5, the vertical axis represents the rotational condition of the electric motors 21L, 21R, and the horizontal axis represents the time. Similarly in (d) of FIG. 5, the vertical axis represents the position of the pushbutton 47 which corresponds to the state of the clutch switch 46, and the horizontal axis represents the time. In (e) of FIG. 5, the vertical axis represents the state of the electromagnetic clutch 45, and the horizontal axis represents the time.

It appears clear from (a) and (b) of FIG. 5 that the forward/reverse speed control lever 51*c* can be set in the forward (F), neutral (N) or reverse (R) position regardless of whether the travel ready lever 41 is disposed in the operating (ON) position or in the inoperating (OFF) position. As evidenced from (a), (b) and (c) of FIG. 5, the electric motors 21L, 21R are allowed to undertake repeated rotation in the forward (F) and reverse (R) directions so long as the travel ready lever 41 is disposed in the operating (ON) position. When the travel ready lever 41 is in the inoperating (OFF) position, the motors 21L, 21R are stopped regardless of the position of the forward/reverse speed control lever 51*c*.

As shown in (a) and (d) of FIG. 5, the clutch control pushbutton switch 46 is able to create a pulse signal regardless of whether the travel ready lever 41 is in the operating (ON) position or in the inoperating (OFF) position. As evidenced from (a), (d) and (e) of FIG. 5, whenever the travel ready lever 41 is in the operating (ON) position, the electromagnetic clutch 45 repeats on-off operation in response to a signal pulse generated from the clutch control pushbutton switch 46. When the travel ready lever 41 is disposed in the inoperating (OFF) position, the electromagnetic clutch 45 is held in the disengaged (OFF) state.

As thus for explained, both the electric motor 21L, 21R and the auger 31 (FIG. 1) that is drivable when the electromagnetic clutch 45 is in the engaged (ON) state are placed in a rotatable condition when the travel ready lever 41 is disposed in the operating (ON) position. When the travel ready lever 41 is brought to the inoperating (OFF) position, rotation of the electric motors 21L, 21R and auger 31 is stopped. Thus, the travel ready lever 41 serves as a lever that places the crawler snowplow 10 in a condition ready to undertake traveling and snow-removing operation and also as a deadman lever that stops traveling and snow-removing operation automatically when the travel ready lever 41 is released in case of emergency.

As thus for explained, the crawler driving wheels 23L, 23R are independently driven by electric motors 21L, 21R, and the power transmission mechanism associated with the auger 31 includes an electromagnetic clutch 45. The electric motors 21L, 21R and the electromagnetic clutch 45 are electrically actuated by using on-off operation of electric switches 40, 46 (47). The switches 40, 46 (47) are actuatable by a force which is considerably smaller than that required to actuate the mechanical clutches incorporated in the conventional snowplows. The snowplow according to the present invention can be maneuvered with small muscular effort.

Furthermore, since the travel ready lever 41 is mounted to only one handlebar 17L, the operator is allowed to undertake the operations using the right hand thereof. This will increase the maneuverability of the snowplow. Additionally, the clutch control pushbutton switch 46 is disposed on the control board 51 at a position close to the right handlebar 17R. By thus arranging the clutch control pushbutton switch 46, the operator is allowed to undertake other operations using the right hand thereof. This may lead to a highly efficient snow-removing operation.

Figure 6:
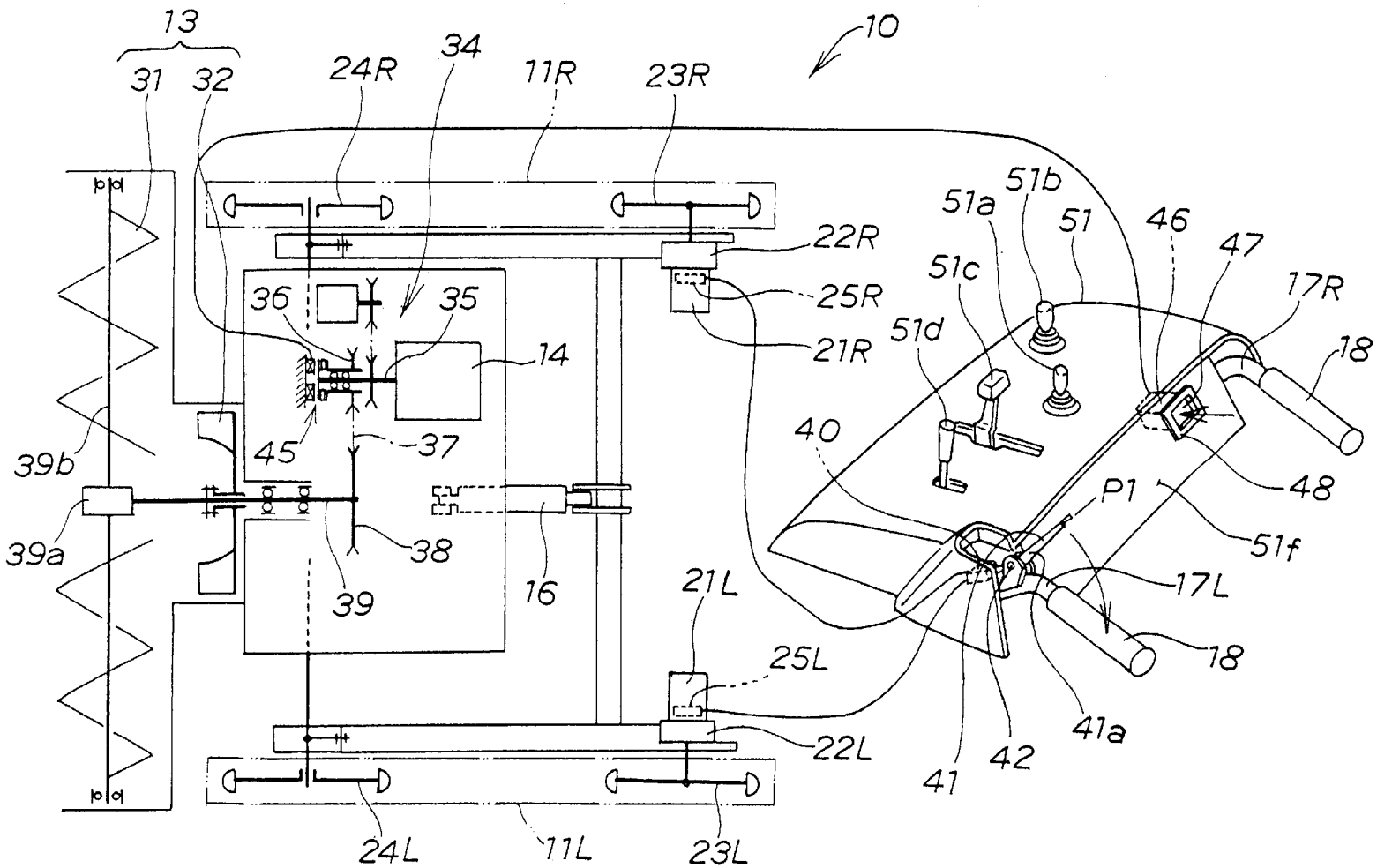
FIG. 6 is a view similar to FIG. 3, showing a particular example of connection between the operation control part and the drive mechanisms of the crawler snowplow.
Figure 7:
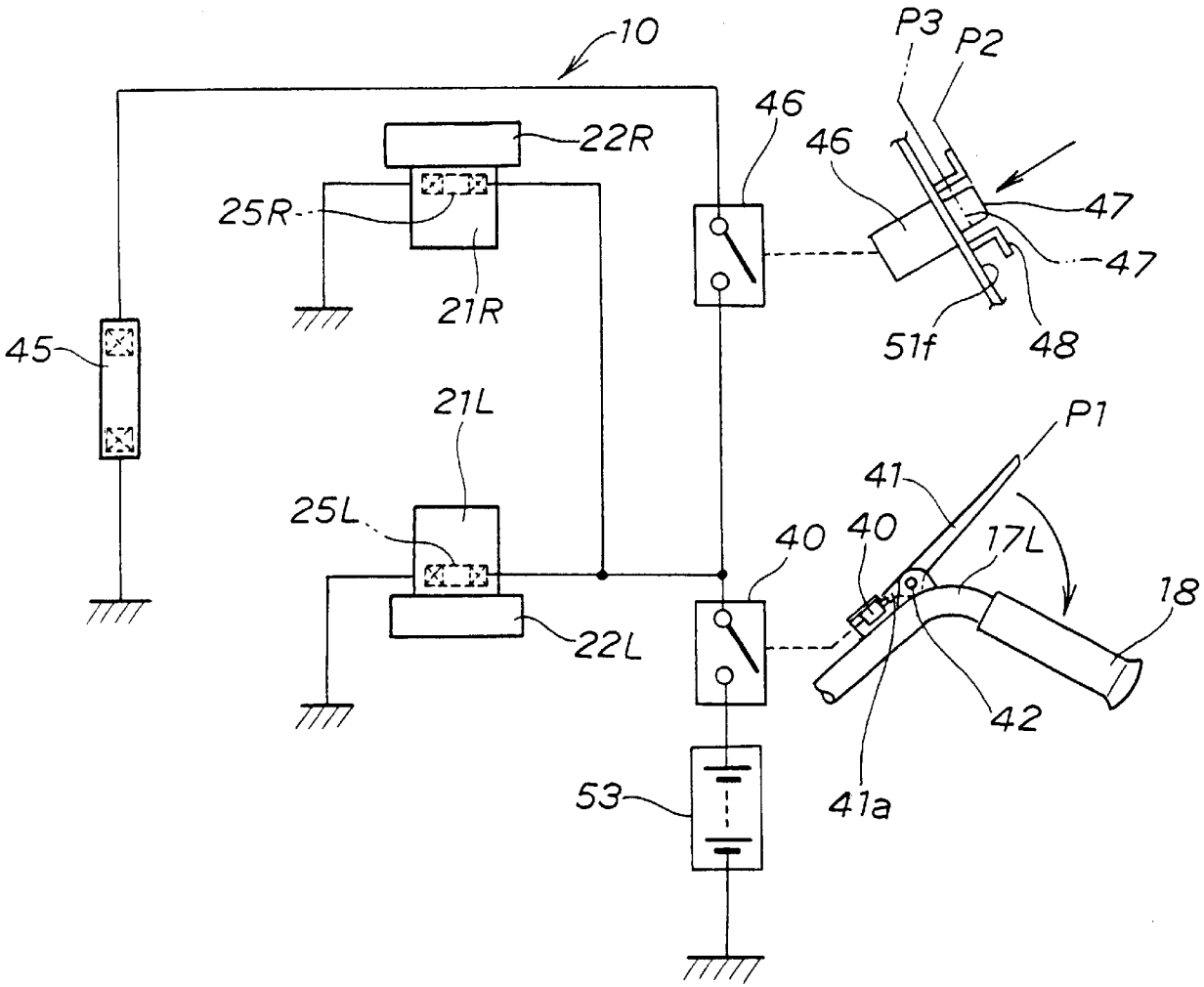
FIG. 7 is a diagrammatical view showing an arrangement for controlling the operation of electromagnetic brakes associated with the crawler driving motors and an electromagnetic clutch associated with an auger drive mechanism.

FIGS. 6 and 7 diagrammatically show a particular example of the arrangement, which places the crawler snowplow 10 in a condition, ready for traveling and snow-removing operation. In FIGS. 6 and 7, the same reference characters designate these parts which are like or corresponding to those of the foregoing embodiment shown in FIGS. 1–5. The arrangement shown in FIGS. 6 and 7 differs from the arrangement of FIGS. 3 and 4 only in that the travel ready lever 41 is operatively connected via the travel ready switch 40 to the electromagnetic brakes 25L, 25R incorporated in the power transmission mechanism (22L, 22R). Thus, the travel ready lever 41 and the travel ready switch 40 are referred to as a brake control lever and a brake control switch, respectively.

When gripped by the left hand of the human operator, the brake control lever 41 pivots from the original inoperating position P1 to an operating position in which the lever 41 lies flat on the left grip 18. With this pivotal movement of the brake control lever 41, the brake control switch 40 is turned on whereupon the electromagnetic brakes 25L, 25R are disengaged. This will allow the crawler belts 11L, 11R to be driven by power transmitted from the electric motors 21L, 21R via the power transmission mechanisms 22L, 22R to the driving wheels 23L, 23R.

As shown in FIG. 7, the brake control switch 40 is connected between the battery 53 and the electromagnetic brakes 25L, 25R. The brake control switch 40 and the brake control lever 41 are arranged such that when the brake control lever 41 is disposed in the original inoperating position P1, a base portion 41*a* of the brake control lever 41 presses or forces an actuator (not designated) of the brake switch 40 to thereby keep the OFF state of the brake control switch 40.

When the brake control lever 41 is caused to swing in the direction of the arrow until the recumbent operating position of the brake control lever 41 is reached, the base portion 41*a* of the brake control lever 41 is disengaged from the actuator of brake control switch 40 whereupon the brake control switch 40 is turned on. The brake control switch 40 comprises a switch having a normally open contact. The electromagnetic brakes 25L, 25R engage when released from electric actuation. Electric actuation disengages the electric brakes 25L, 25R.

The clutch switch 46 is disposed between and connected in series with the brake control switch 40 and the electromagnetic clutch 45. The clutch switch 46 is tuned off when the pushbutton 47 is in the original inoperating position P2 indicated by the solid line shown in FIG. 7. When the pushbutton 47 is depressed to assume the phantom-lined operating position P3, the clutch switch 46 is turned on. Thus, the clutch switch 46 is a switch having a normally open contact. Electric actuation engages the electromagnetic clutch 45. The electromagnetic clutch 45 disengages when electric actuation is released.

Though not shown, these switches 40, 46 are electrically connected to the control unit 52 (FIG. 1) so that the initial state of the switch contact is checked for detection of a failure of each switch 40, 46. This arrangement increases the reliability in operation of the switches 40, 46.

In operation, the brake control lever 41 is gripped together with the grip 18 of the left handlebar 17L. This operation causes the brake control lever 41 to swing from the original in operating position P1 to the recumbent operating position. When the brake control lever 41 reaches the operating position, the brake control switch 40 is turned on to thereby electrically actuate the electromagnetic brakes 25L, 25R. Upon actuation, the electromagnetic brakes 25L, 25R disengage so that power from the electric motors 21L, 21R can be transmitted via the power transmission mechanisms 22L, 22R to the crawler driving wheels 23L, 23R, thus propelling the crawler snowplow 10.

While keeping this condition, the pushbutton 47 is depressed with the operator's right hand until the pushbutton 47 assumes the phantom-lined operating position P3. When the pushbutton 47 reaches the operating position, the clutch switch 47 is turned on to thereby electrically actuate the electromagnetic clutch 45. Electric actuation engages the electromagnetic clutch 45 whereupon the auger 31 and the blower 32 are rotated by rotational power from the engine 14 (FIG. 6).

The push button 47 of the clutch switch 46 is temporarily locked in the operating position to thereby keep the engaged state of the electromagnetic clutch 45 even when the pressure on the pushbutton 47 is released. The operator is therefore allowed to use its right hand for the purpose of operating other levers. This will increase the efficiency of the snow-removing operation by the snowplow 10.

Furthermore, since the electromagnetic clutch 45 remains in its engaged position even after removal of a manual pressure on the pushbutton 47, it is no longer necessary to provide such a connecting mechanism which is used in the conventional snowplow to mechanically join two levers mounted on the left and right handlebars. Due to the absence of the connecting mechanism, the actuators (brake control lever 41 and the clutch control pushbutton switch 46) used for actuating the electromagnetic brakes 25L, 25R and the electromagnetic clutch 45, that is the brake control lever 41 and the clutch switch 46 are simple in construction and easy to maintain and do not increase the manufacturing cost of the snowplow 10.

Thereafter, the pushbutton 47 of the clutch switch 46 is pushed again while the brake control lever 41 is kept gripped in the operating position P3. The pushbutton 47 is thus allowed to automatically return to the inoperating position P2. With this backward movement of the pushbutton 47, the clutch switch 46 is turned off, thereby disengaging the electromagnetic clutch 45. Transmission of rotational power from the engine 14 to the snow-removing mechanism 13 is terminated with the result that rotation of the auger 31 and blower 32 is stopped.

When gripping of the brake control lever 41 is released while the pushbutton 47 is held in the operating position, the brake control lever 41 automatically returns to the original inoperating position P1. With this return movement of the brake control lever 41, the brake control switch 40 is turned off and, hence, the electromagnetic brakes 25L, 25R return to the engaged state. By the effect of braking forces applied from the electromagnetic brakes 25L, 25R, the electric motors 21L, 21R are locked against rotation and, hence, traveling operation of the crawler snowplow 10 is terminated.

In this instance, since the brake control switch 40 is disposed in series circuit between the battery 53 and the clutch switch 76, the supply of electric power from the battery 53 to the electromagnetic clutch 45 is interrupted when the brake control switch 40 is turned off. Thus, the electromagnetic clutch 45 is forcibly returned to the disengaged state and rotation of the auger 31 and blower 32 is stopped even though the pushbutton 47 of the clutch switch 46 is held in its operating position P3. It will be appreciated that merely by releasing brake control lever 41, running of the crawler snowplow 10 and rotation of the auger 31 and blower 32 are stopped concurrently.

Figure 8:
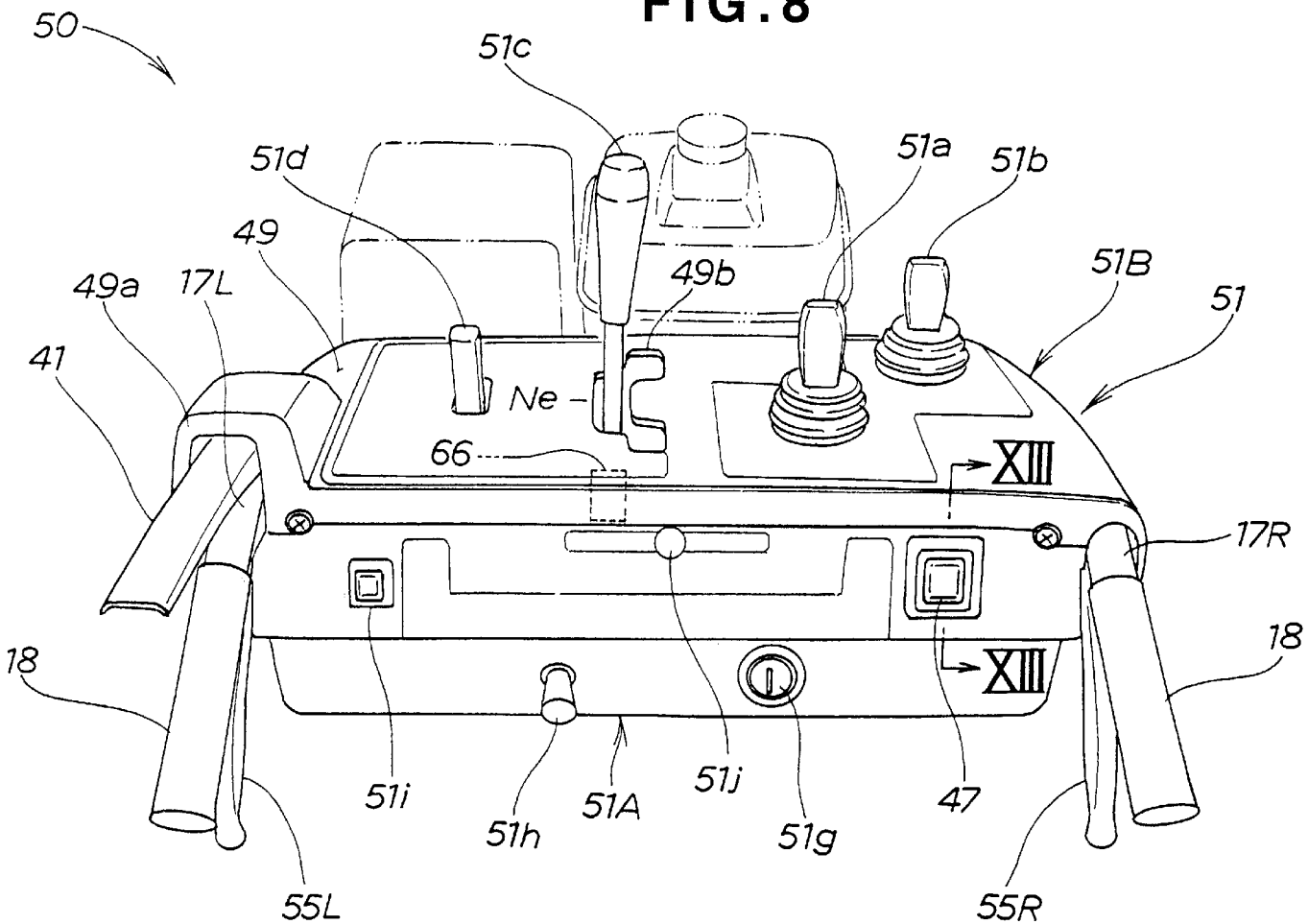
FIG. 8 is a perspective view showing the general arrangement of the operation control part of the crawler snowplow.

FIG. 8 is a detailed view of an operation control part 50 of the crawler snowplow 10 (FIG. 1). The operation control part 50 includes the control board 51 disposed between the left and right handlebars 17L, 17R, the travel ready lever 41 mounted to the left handlebar 17L in the proximity of the grip 18, and the left and right turn control levers 55L, 55R mounted to the left and right handlebars 17L, 17R in the proximity of the grips 18.

Figure 9:
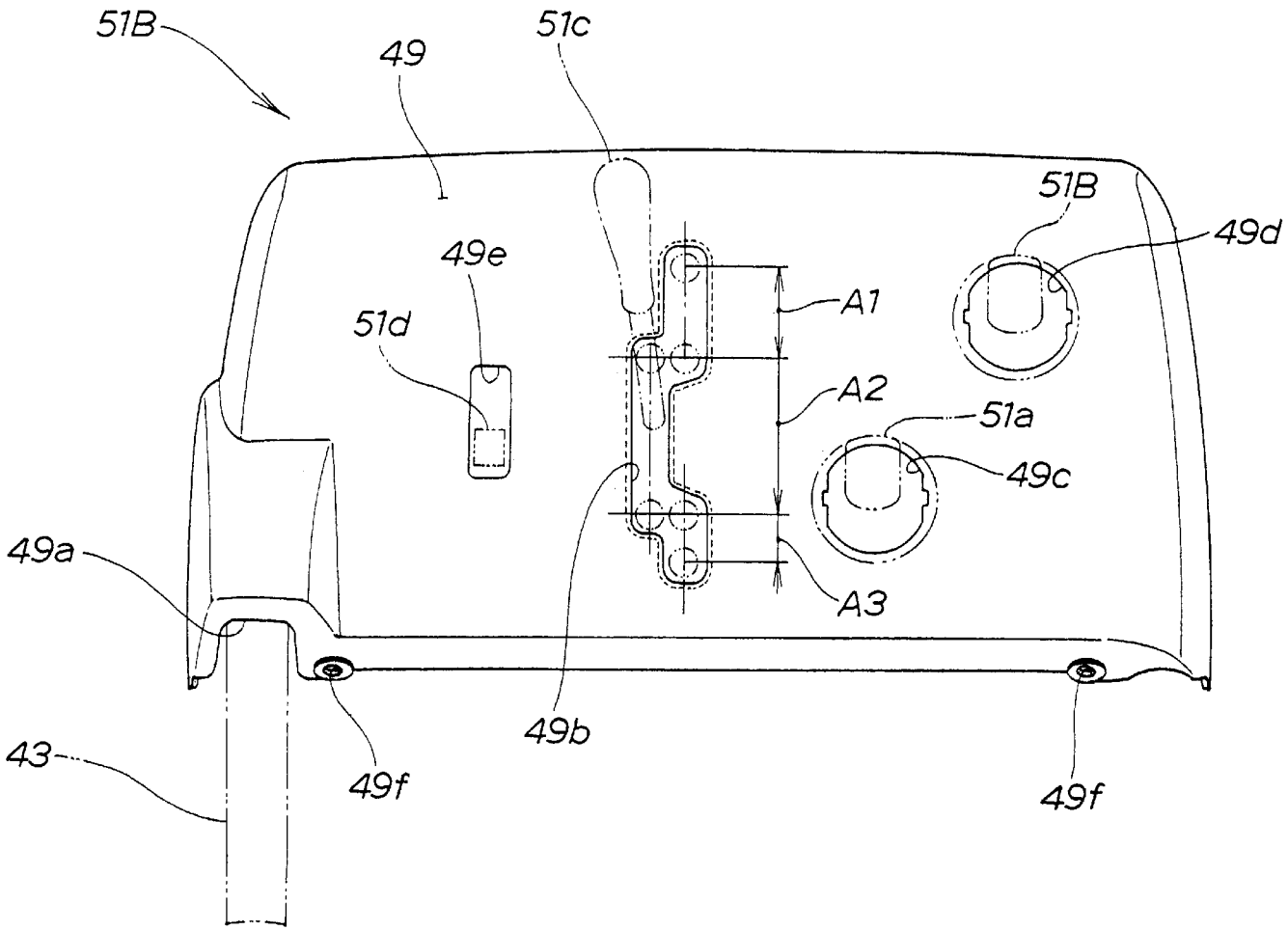
FIG. 9 is a plan view of a control board of the operation control part.

The control board 51 is composed of a control box 51A extending between the left and right handlebars 17L, 17R and a control panel 51B covering an upper opening of the control box 51A. The control panel 51B is provided with the lift control lever 51*a*, the shooter control lever 51*b*, the forward/reverse speed control lever 51*c* and the throttle lever 51*d* that are all described previously. The control box 51A is provided with the pushbutton 47 forming an integral part of the clutch switch (auger switch) 46 (FIG. 4), a main switch (key switch) 51*g*, a choke knob 51*h* that may be used when the engine 14 (FIG. 1) is started, a light button 51*i* for turning on and off the lamp 56*e* (FIG. 1), and a failure lamp 51*j* adapted to be turned on when a failure occurs. FIG. 9 is a plan view of the control panel 51. As shown in this figure, the control panel 51B has an upwardly projecting cover portion 49*a* for covering a base portion of the travel ready lever 41, an elongated guide groove 49*b* for guiding movement of the forward/reverse speed control lever 51*c*, generally circular openings 49*c* and 49*d* used for mounting the lift control lever 51*a* and the shooter control lever 51*b*, respectively, and an elongated guide groove 5*d* for the throttle lever 51*d*. Reference character 49*f* denotes fastener holes used for attaching the control panel 51B to the control box 51A by means of screws.

The guide groove 49*b* is cranked and extends in the longitudinal direction (front-to-rear direction) of the crawler snowplow. The guide groove 49*b* has a forward first guide region A1 used for propelling the snowplow in the forward direction, an intermediate second guide region A2 used for moving the snowplow back and forth, and a rearward third guide region A3 used for propelling the snowplow in the backward direction.

Figure 10:
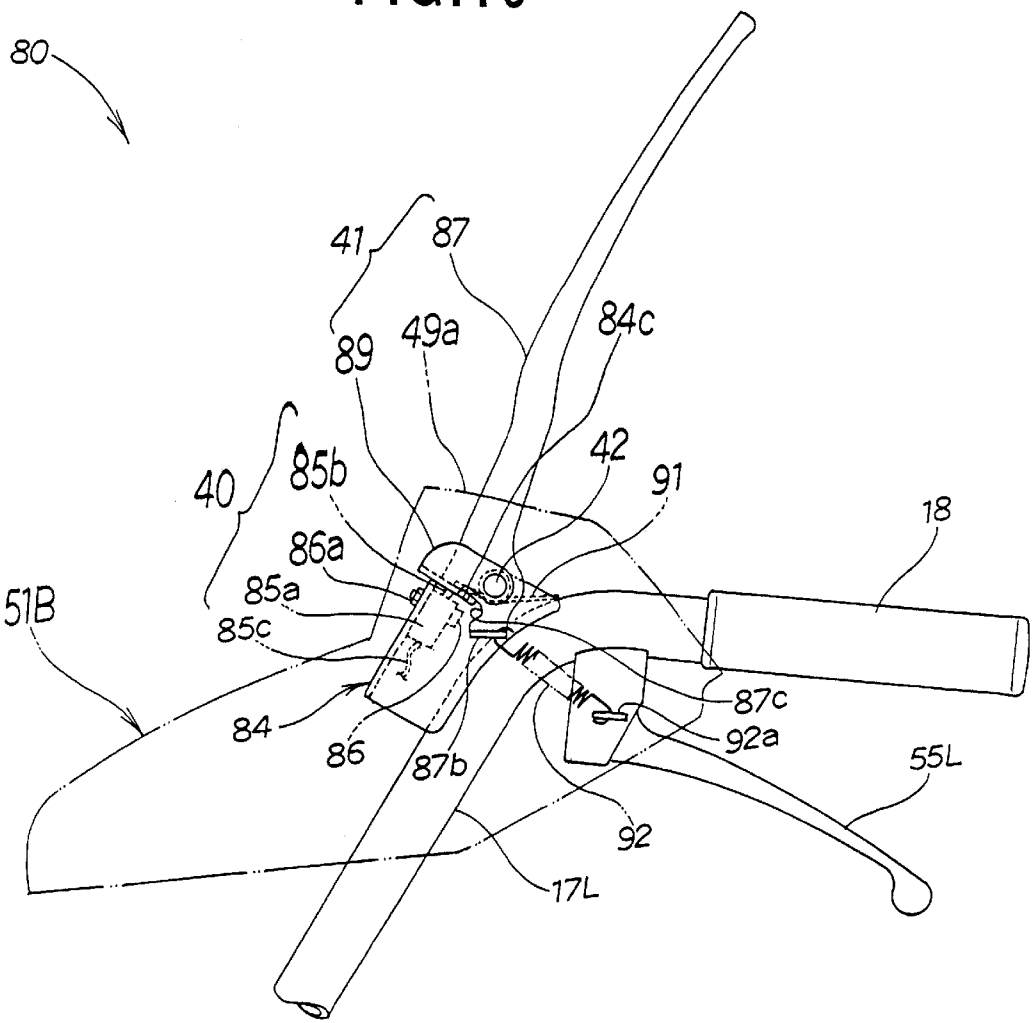
FIG. 10 is a side view showing a left operation handlebar and a travel ready lever mounted to the handlebar.

FIG. 10 shows a switch mechanism 80 generally comprises the travel ready lever 41 mounted to the left handlebar 17L via a bracket 84, and the travel ready switch 40 adapted to be actuated by the travel ready lever 41. The bracket 84 has a U-shaped cross section, and the switch 40 is disposed in an internal space of the U-shaped bracket 84 and has an actuator 85*b* projecting outward from an upper end 84*c* of the bracket 84. The travel ready lever 41 has a pusher member 89 designed to push the actuator 85*b* while closing the open upper end 84*c* of the U-shaped bracket 84. This arrangement is able to isolate the switch 40 from rain or snow and thus increases the service life of the switch 40 and the reliability of the switch mechanism 80 as a whole.

Figure 11:
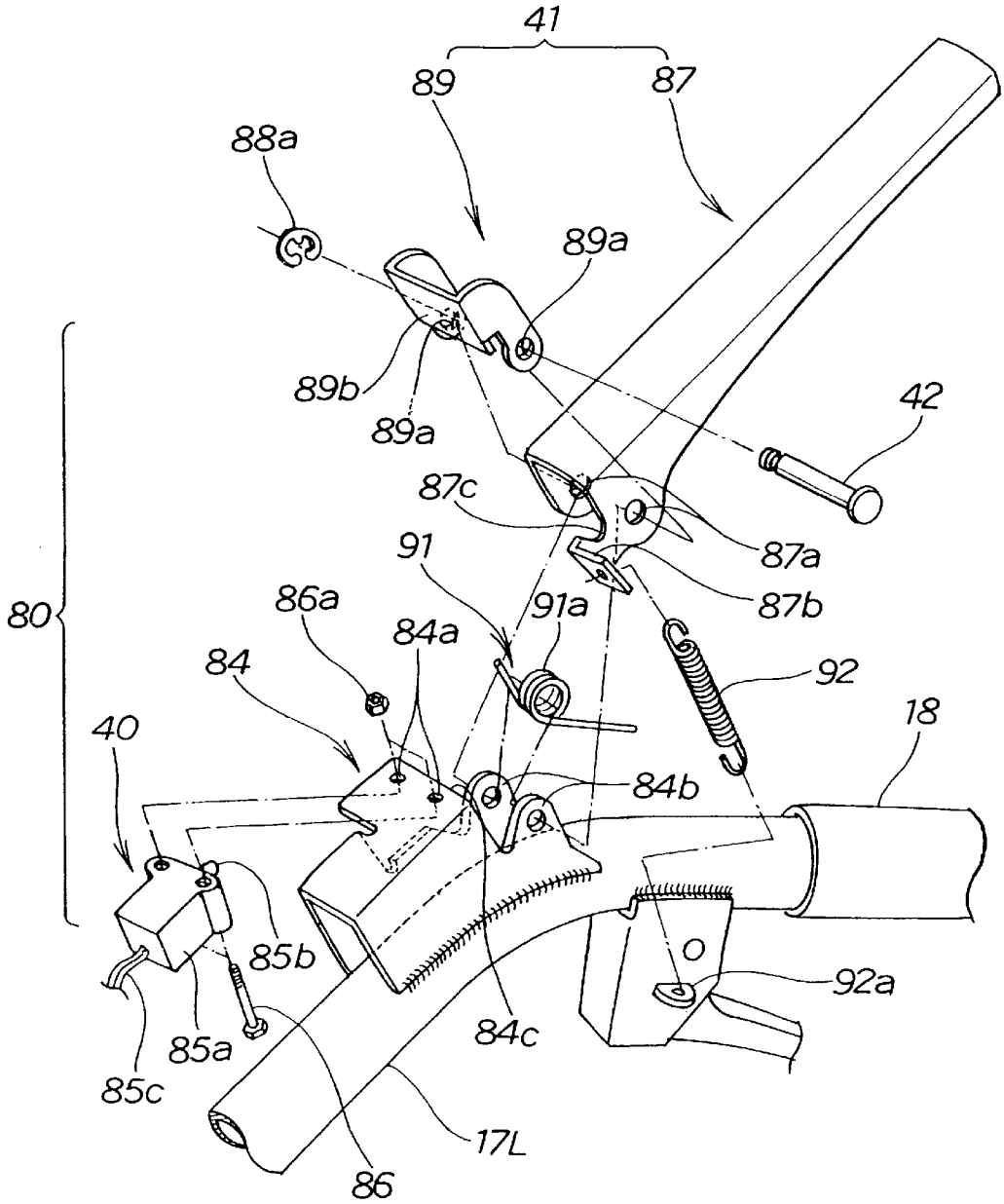
FIG. 11 is an exploded perspective view of a switch mechanism having a switch adapted to be actuated by the travel ready lever.

As best shown in FIG. 11, the bracket 84 has a U-shaped cross section and is attached by welding to the left handlebar 17L with its bottom wall facing upward (the bottom wall being hereinafter referred to as "top wall"). The bracket 84 thus attached has an internal space in which the travel ready switch 40 is accommodated. The bracket 84 has two holes 84*a*, 84*a* used for mounting the switch 40 to the bracket 84, and a pair of laterally spaced support lugs 84*b* used for pivotally supporting the travel ready lever 41. The support lugs 84*b* are formed as a part of the sidewalls of the bracket 84. One end 84*c* of the U-shaped bracket 84, which is located close to the support lugs 84*b*, is open. The open end 84*c* serves as a stopper that limits the range of pivotal movement of the travel ready lever 41. Use of the bracket 84 having a stopper function reduces the number of structural components of the switch mechanism 80 and contributes to the cost reduction of the switch mechanism 80.

The travel ready switch 40 has a switch body 85*a*, the actuator 85*b* retractably mounted on the switch body 85*a*, and a wire harness 85*c* drawn from the switch body 85*a*. The switch body 85*a* is attached to the bracket 84 by a plurality of screws 86 and nuts 86*a* (only one being shown).

The travel ready lever 41 is composed of a lever body 87 adapted to be gripped by the human operator, the pusher member 89 pivotally mounted by the pin 42 to the support lugs 84*b* of the bracket 84 together with the lever body 87, a torsion spring 91 acting between the pusher member 89 and the left handlebar 17L, and a tension spring 92 acting between the lever body 87 and the left handlebar 17L. The pin 42 is locked in position by a stop ring 88*a*.

The lever body 87 has a U-shaped cross section and also has a transverse hole extending through a base portion (proximal end portion) of the lever body 87 for the passage therethrough of the pin 42, a spring support lug 87*b* to which one end of the tension spring 92 is connected, and an recessed engagement portion 87*c* for engagement with the pusher member 89 to activate the switch 40. The opposite end of the tension spring 92 is connected to a spring support lug 92*a* formed on the left handlebar 17L.

The pusher member 89 has a U-shaped cross section including a flat bottom wall 89*b* and a pair of sidewalls (not designated) having holes formed therein for the passage therethrough of the pin 42. The sidewalls receive therebetween the base portion of the lever body 87. The flat bottom wall 89*b* depresses the actuator 85*b* of the switch 40 and closes the open end 84*b* of the bracket 84, as will be explained later on. The torsion spring 91 has a coiled portion 91*a* loosely fitted around the pin 42. One end of the torsion spring 91 engages the flat bottom wall 89*b* of the pusher member 89, and the other end of the torsion spring 91 engages a portion of the left handlebar 17L.

Figure 12A:
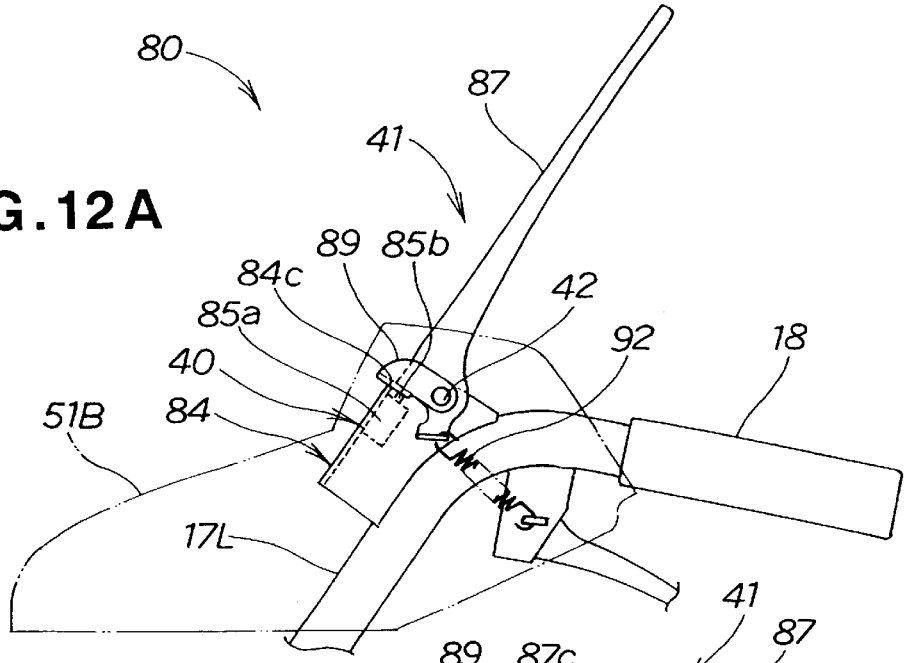
FIGS. 12A through 12C are side views illustrative of the operation of the switch mechanism.
Figure 12B:
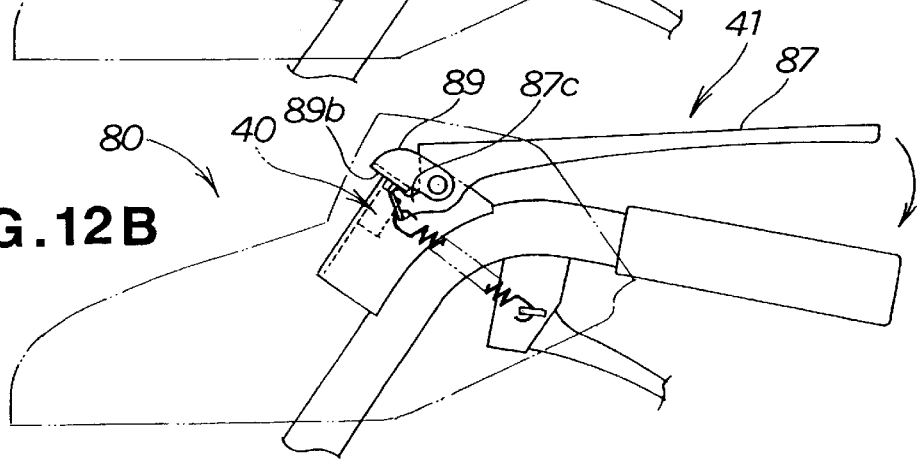
Figure 12C:
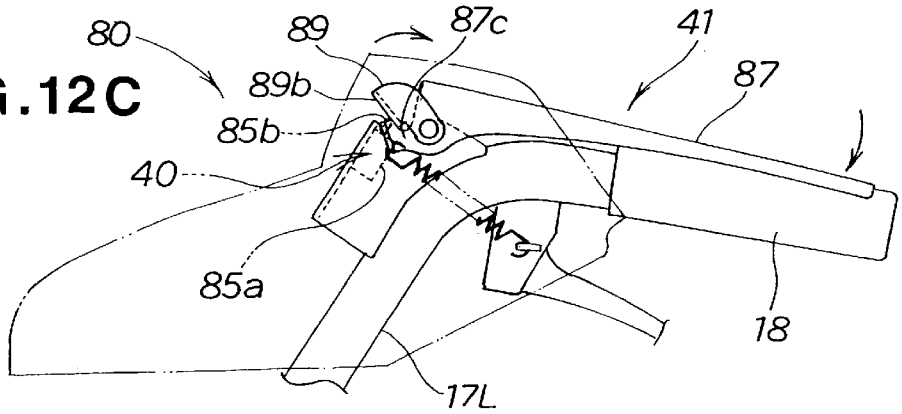

Operation of the switch mechanism 80 will be described with reference to FIGS. 12A through 12C. The switch mechanism 80 is initially disposed in the position shown in FIG. 15A. As shown in FIG. 15A, the flat bottom wall 89*b* (FIG. 11) of the pusher member 89 is held in abutment with the open end 84*c* of the U-shaped bracket 84 so that the open end 84*c* is closed and the actuator 85*b* of the switch 40 is in its retracted position as it is depressed by the pusher member 89. The switch 40 is in the OFF state when the actuator 85*b* is in its retracted position. The engagement portion 87*c* (FIG. 11) of the lever body 87 is disengaged from the pusher member 89. As previously described with reference to FIGS. 1–5, the travel ready lever 41 is a lever adapted to be manually operated to place the electric motors 21L, 21R (FIG. 1) in an operative condition.

When the travel ready lever 41 is gripped by the human operator, the lever body 87 is caused to swing toward the handlebar 17L against the force of the tension spring 92, as shown in FIG. 15B. In the course of pivotal movement of the lever body 87, the engagement portion 87*c* of the lever body 87 does not engage the flat bottom wall 89*b* of the pusher member 89 until the lever body 87 reaches a predetermined position located near the operating position of the travel ready lever 41 where the lever body 87 lies flat on the grip 18 of the left handlebar 17L, as shown in FIG. 15C. Accordingly, the pusher member 89 is held in its original position by the fore of the torsion spring 91 (FIG. 11), So that the open end 84*c* of the bracket 84 is kept closed and the actuator 85*b* of the switch 40 is held in its retracted position. The switch 40 is in the OFF state.

Further gripping of the travel ready lever 41 cause the lever body 87 to approach the operating position (FIG. 15C) of the travel ready lever 41. As the lever body 87 approaches the operating position of the travel ready lever 41, the engagement portion 87*c* first comes in contact with a lower edge of the flat bottom wall 89*b* of the pusher member 89, and subsequently forces the flat bottom wall 89*b* upward to thereby turn the pusher member 89 clockwise about the pin 42 (FIG. 15A) against the force of the torsion spring 91 (FIG. 11). Thus, the flat bottom wall 89*b* of the pusher member 89 is displaced away from the open end 84*c* of the bracket 84, allowing the actuator 55*b* of the switch 40 to move from the retracted position to the projecting position shown in FIG. 15C. With this projecting movement of the actuator 85*b*, the switch 40 is turned on and, hence, the electric motors 21L, 21R (FIG. 1) are placed in an operative condition by, for example, releasing or disengaging the electromagnetic brakes 25L, 25R associated with the electric motors 21L, 21R.

The travel ready lever 41, which is composed of the lever body 87 and the pusher member 89 pivotally connected together with a space initially defined between the engagement portion 87*c* of the lever body 87 and the flat bottom wall 89*b* of the pusher member 894*c*, forms a lost motion mechanism that provides a delay between the movement of a driver (lever body 87) and the movement of a follower (pusher member 89). By properly setting the spacing between the engagement portion 87*c* and the flat bottom wall 89*b*, the on-off timing of the switch 40 can be adjusted. The switch mechanism 80 of this construction has a higher degree of design freedom.

Figure 13:
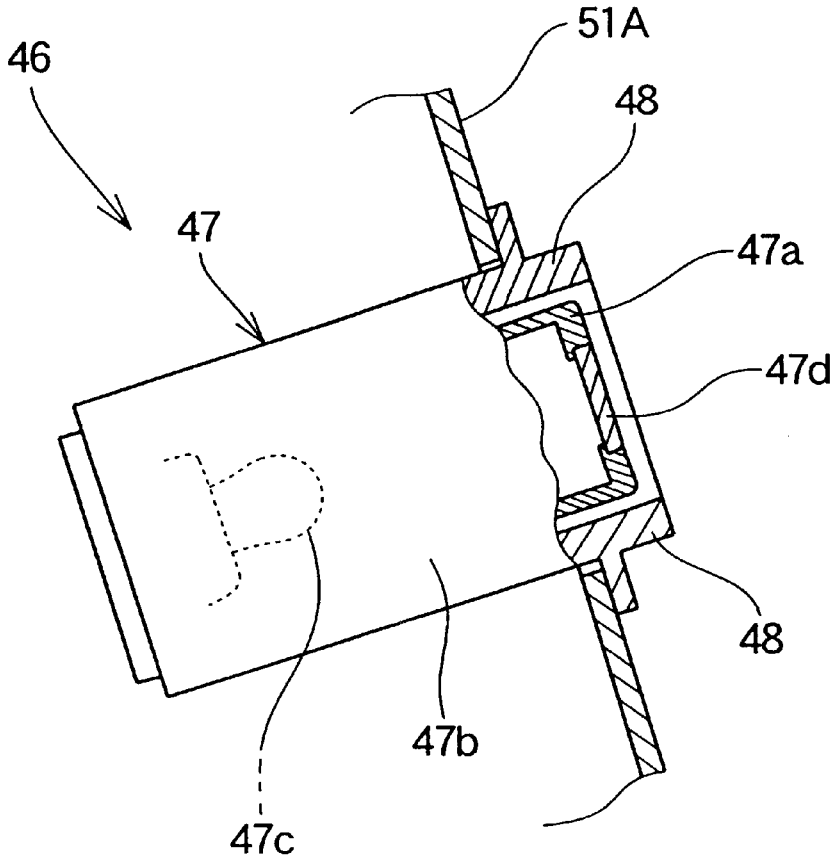
FIG. 13 is a partial cross-sectional view taken along line XIII—XIII of FIG. 8, showing a clutch control push button switch of the operation control part.

The clutch switch (auger switch) 46 shown in FIG. 13 comprises an automatic reset pushbutton switch that keeps the ON state only when the pushbutton 47*a* is depressed; when the pushbutton 47*a* is released, the switch 46 automatically returns to the OFF state. The auger switch 46 includes a case 47*b* having a built-in lamp 47*c*. Light emitted from the lamp 47*c* passes through a transparent plate 47*d* provided at the top of the pushbutton 47*a*, so that the switch 46 can readily be visually recognized even in the dark or during snowfall.

The case 47*b* of the switch 46 also has a guard 48 extending around the pushbutton 47*a*. The guard 48 projects outward from the front surface of the pushbutton 47*a* so as to protect the switch 46 against unintentional access tending to turn on or off the switch 46.

Figure 14:
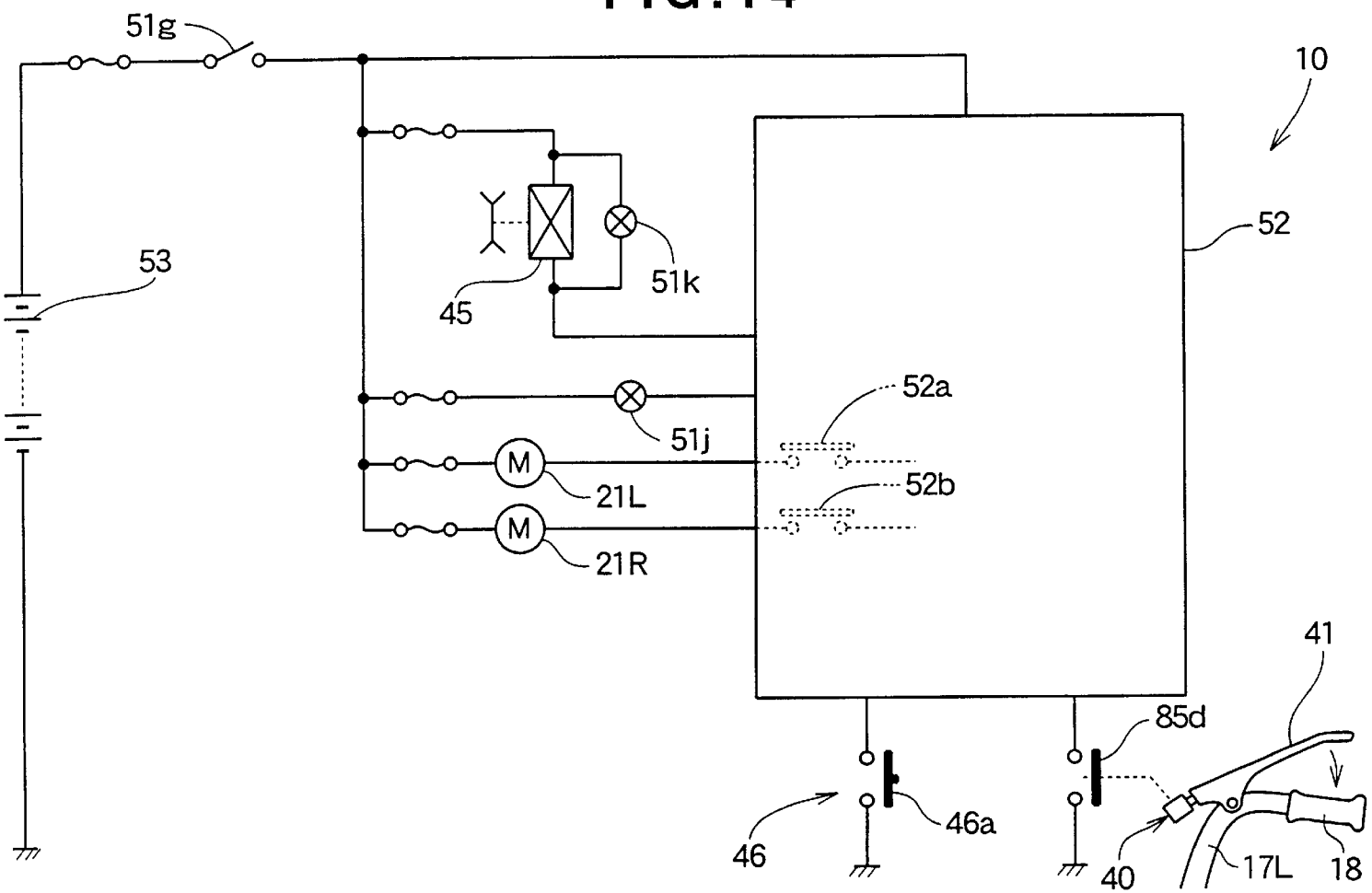
FIG. 14 is a circuit diagram showing the connection between the clutch control pushbutton switch and a switch associated with the travel ready lever.

FIG. 14 is a circuit diagram of a control circuit in which the auger switch 46 of FIG. 13 is used in combination with the travel ready lever 41. As shown in FIG. 14, the control unit 52, the electromagnetic clutch 45, the failure lamp 51*i*, an auger lamp 51*k*, and the left and right electric motors 21L, 21R are connected via the main switch 51*g* to the battery 53. A contact set 46*a* of the auger switch 46 and a contact set 85*d* of the travel ready switch 40 are connected to the control unit 52.

The contact set 46*a* of the auger switch 46 is a normally open contact, and only when the pushbutton 47*a* (FIG. 13) is depressed, the contact 46*a* is closed, thereby activating or setting the auger switch 46 in the ON state. Upon activation of the auger switch 46, an ON signal is supplied from the switch 46 to the control unit 52. The contact set 85*d* of the travel ready switch 40 is also a normally open contact, and only when the travel ready lever 41 is in the operating position as it is gripped together with the left grip 18, the contact 85*d* is closed, thereby activating or setting the travel ready switch 40 in the ON state. Upon activation of the travel ready switch 40, an ON signal is supplied from the switch 40 to the control unit 52.

The control unit 52 judges by the presence of the ON signal from the travel ready switch 40 that the crawler snowplow 10 is in a condition ready for traveling. Based on this judgment, the control unit 52 turns on internal switches 52*a*, 52*b* to thereby place the electric motors 21L, 21R in an operative condition.

The control unit 52 also activates the electromagnetic clutch 45 and turns on the auger lamp 51*k* on condition that both the ON signal from the travel ready switch 40 and the ON signal from the auger switch 46 have been received.

The control unit 52 further performs a diagnostic function so as to detect a failure in the switches 40, 46. The control unit 52 checks the initial state of the switch contact 46*a*, 85*d* of each switch and when a failure is detected, the control unit 52 turns on the failure lamp 51*j*. Checking is achieved on the bases of the presence of chattering of the switch contacts 46*a*, 85*d*, or the level of voltage appearing across the switch contacts 46*a*, 85*d*. By thus checking the initial state of the switch contacts, the reliability in operation of the switches 40, 46 is improved.

Figure 15:
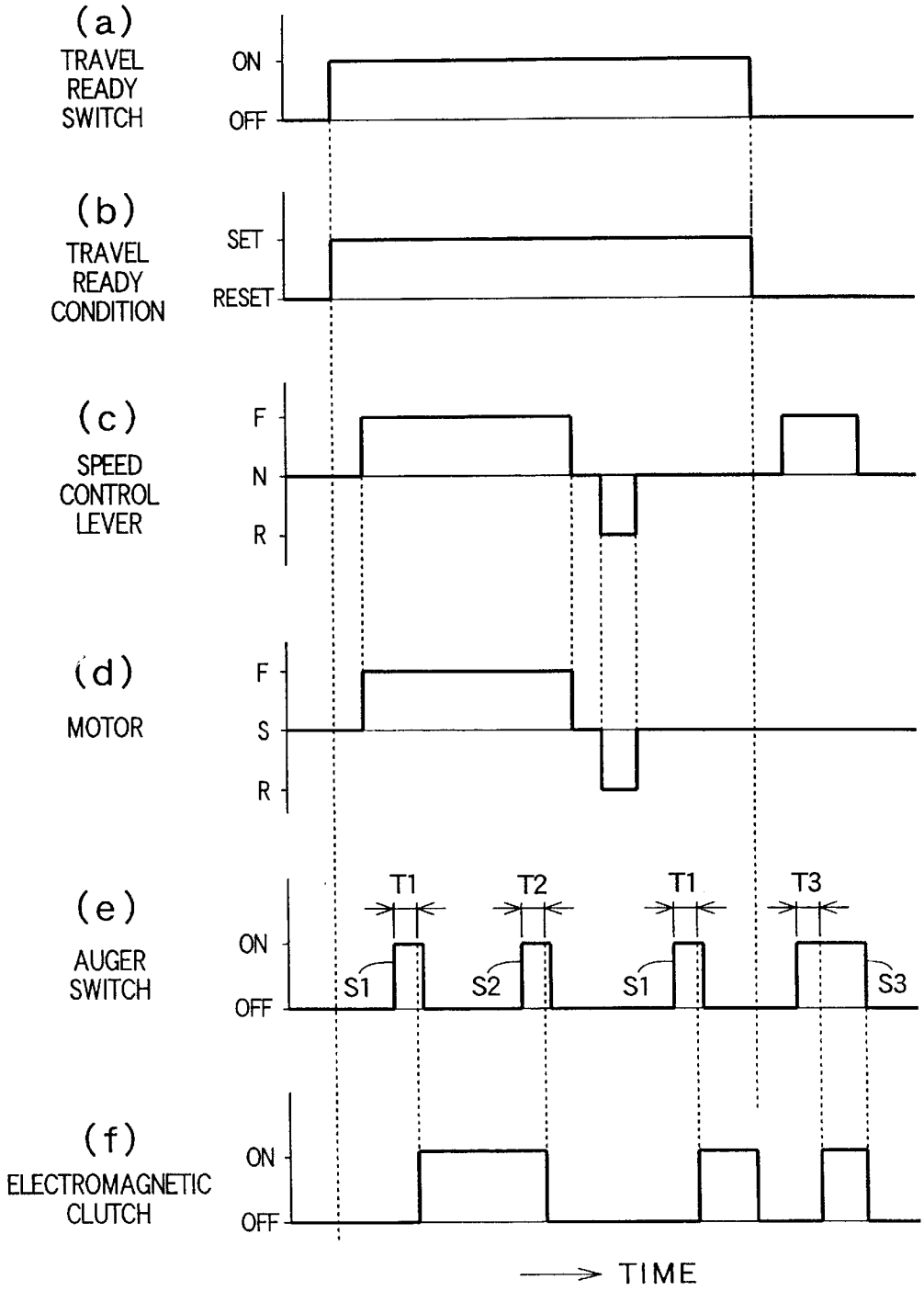
FIG. 15 is a time chart showing the operation of the crawler snowplow.

FIG. 15 is a time chart illustrative of operation of the control unit 52. (a) of FIG. 14 shows the on-off operation of the travel ready switch 40. (b) of FIG. 4 shows the travel ready condition of the crawler snowplow. As evidenced from (a) and (b) of FIG. 14, the crawler snowplow is set in the travel ready condition when the travel ready switch 40 is in the ON state. When the when the travel ready switch 40 shifts from the ON state to the OFF state, the travel ready condition of the crawler snowplow is reset.

(c) of FIG. 15 shows the operation of the forward/reverse speed control lever 51*c*. As shown in this figure, the forward/reverse speed control lever 51*c* is movable between the forward (F), neutral (N) and reverse (R) positions. (d) of FIG. 15 shows the operation of the electric motors 21L, 21R. As evidenced from (b) and (d) of FIG. 15, the electric motors 21L, 21R are allowed to rotate only when the crawler snowplow is set in the travel ready condition. As seen from (c) and (d) of FIG. 15, when the forward/reverse speed control lever 51*c* is in the forward (F) position, the electric motors 21L, 21R rotate in the forward (F) direction, thereby propelling the snowplow in the forward direction. When the forward/reverse speed control lever 51*c* is disposed in the neutral (N) position, the electric motors 21L, 21R is stopped (S). Similarly, when the forward/reverse speed control lever 51*c* is in the reverse (R) position, the electric motors 21L, 21R rotate in the reverse (R) direction, thereby propelling the crawler snowplow in the reverse or backward direction.

(e) of FIG. 15 shows the on-off operation of the auger switch 46, and (f) of FIG. 15 shows the operation of the electromagnetic clutch 45. As evidence from (a), (b), (e) and (f) of FIG. 15, the electromagnetic clutch 45 operates in three different modes. The first operation mode occurs when a first ON signal pulse S1 (tending to activate or engage the electromagnetic clutch 24) and a subsequent second ON signal pulse S2 (tending to deactivate or disengage the electromagnetic clutch 45) are supplied repeatedly while the crawler snowplow is set in the travel ready condition. In the first operation mode, the electromagnetic clutch 45 repeats on-off operation.

The second operation mode of the electromagnetic clutch 45 occurs when the travel ready condition of the crawler snowplow is reset after the first ON signal pulse S1 has been received and before the second ON signal pulse S2 is received. In the second operation mode, the electromagnetic clutch 45 is deactivated or disengaged when the travel ready condition of the crawler snowplow is reset.

The third operation mode of the electromagnetic clutch 45 occurs when an ON signal pulse S3 from the auger switch 46 is received when the travel ready switch 40 is in the OFF state (namely, the travel ready condition of the crawler snowplow has been reset). In the third operation mode, the electromagnetic clutch 45 is activated or engaged.

As seen from (e) of FIG. 15, the control unit 52 recognizes the receipt of the first ON signal pulse S1 when the pulse duration (i.e., ON time of the signal pulse S1) reaches a preset first reference time T1. Similarly, the receipt of the second ON signal pulse S2 is recognized by the control unit 52 when the pulse duration of the signal pulse S2 reaches a preset second reference time T2. The control unit 52 recognizes the receipt of the ON signal pulse S3 when the pulse duration (i.e., ON time of the signal pulse S3) reaches a preset third reference time T3. By thus checking the receipt of the signal pulses S1–S3 by comparison with the corresponding preset reference times, the on-off operation of the electromagnetic clutch 45 is performed with high reliability. The first, second and third reference-times T1, T2, and T3 may be equal to one another.

When the travel ready switch 40 is in the ON state as shown in (a) of FIG. 15, a first condition is satisfied in which the signal produced from the travel ready switch 40 upon actuation by the travel ready lever 41 forms a travel permission signal that permits rotation of the driving wheels 23L, 23R by the electric motors 21L, 21R. Similarly, when the travel ready switch 40 is in the OFF state as shown in (a) of FIG. 15, a second condition is satisfied in which the signal produced from the travel ready switch 40 upon actuation by the travel ready lever 41 forms a stop signal that stops rotation of the driving wheels 23L, 23R by the electric motors 21L, 21R.

In (e) of FIG. 15, the first ON signal pulse S1 from the auger switch 46 meets a third condition in which at least one clutch-on signal from the auger switch 46 has been received. Similarly, in (e) of FIG. 15, the signal S3 from the auger switch 46 meets a fourth condition in which the clutch-on signal from the auger switch 46 is recognized as a continuous signal.

When the first and third conditions are satisfied, it is possible to activate or engage the electromagnetic clutch 45. Similarly, when the second and fourth conditions are satisfied, it becomes possible to activate or engage the electromagnetic clutch 45.

Figure 16:
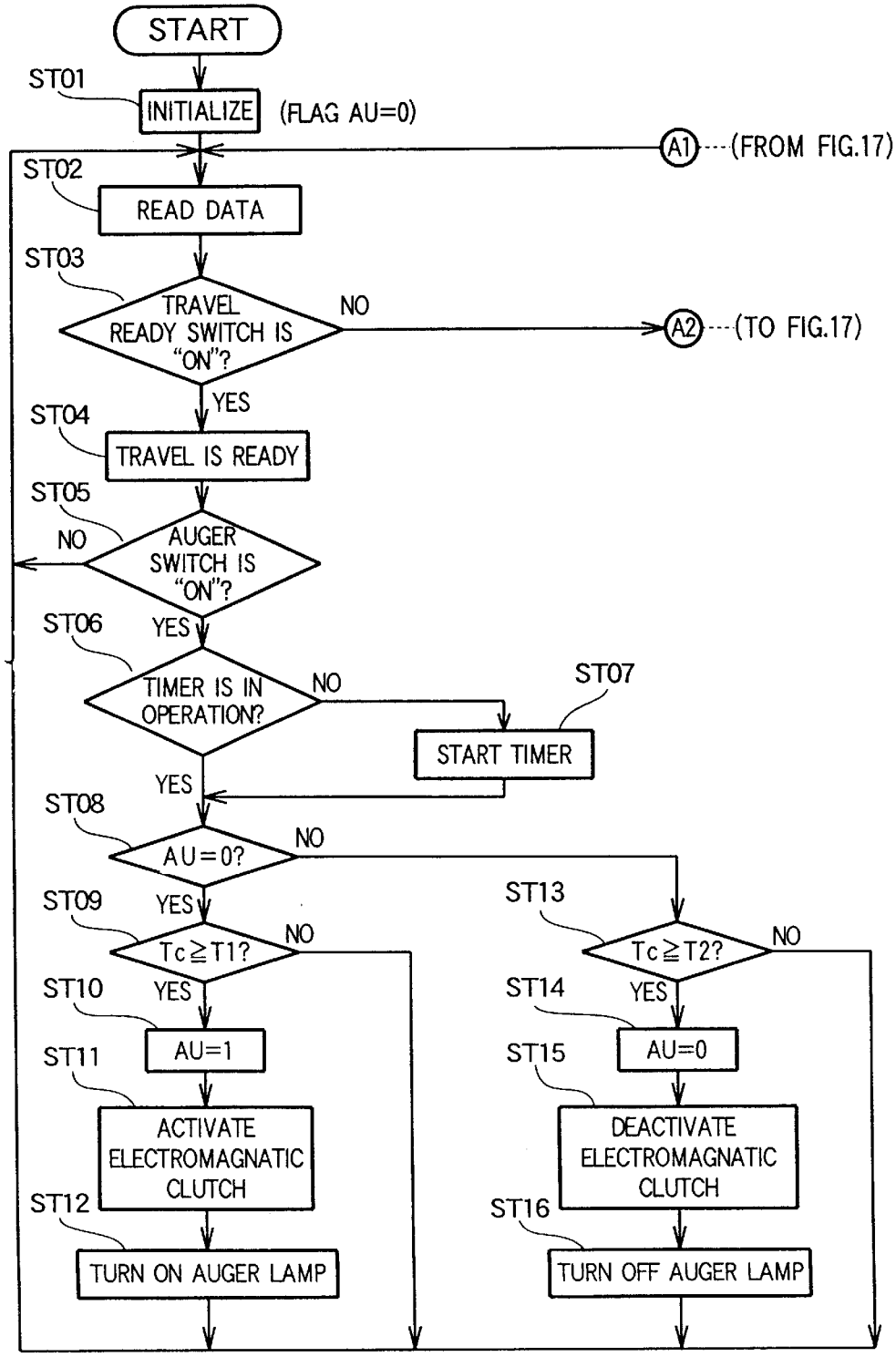
FIG. 16 is a flowchart showing a control procedure for controlling the operation of the crawler snowplow.
Figure 17:
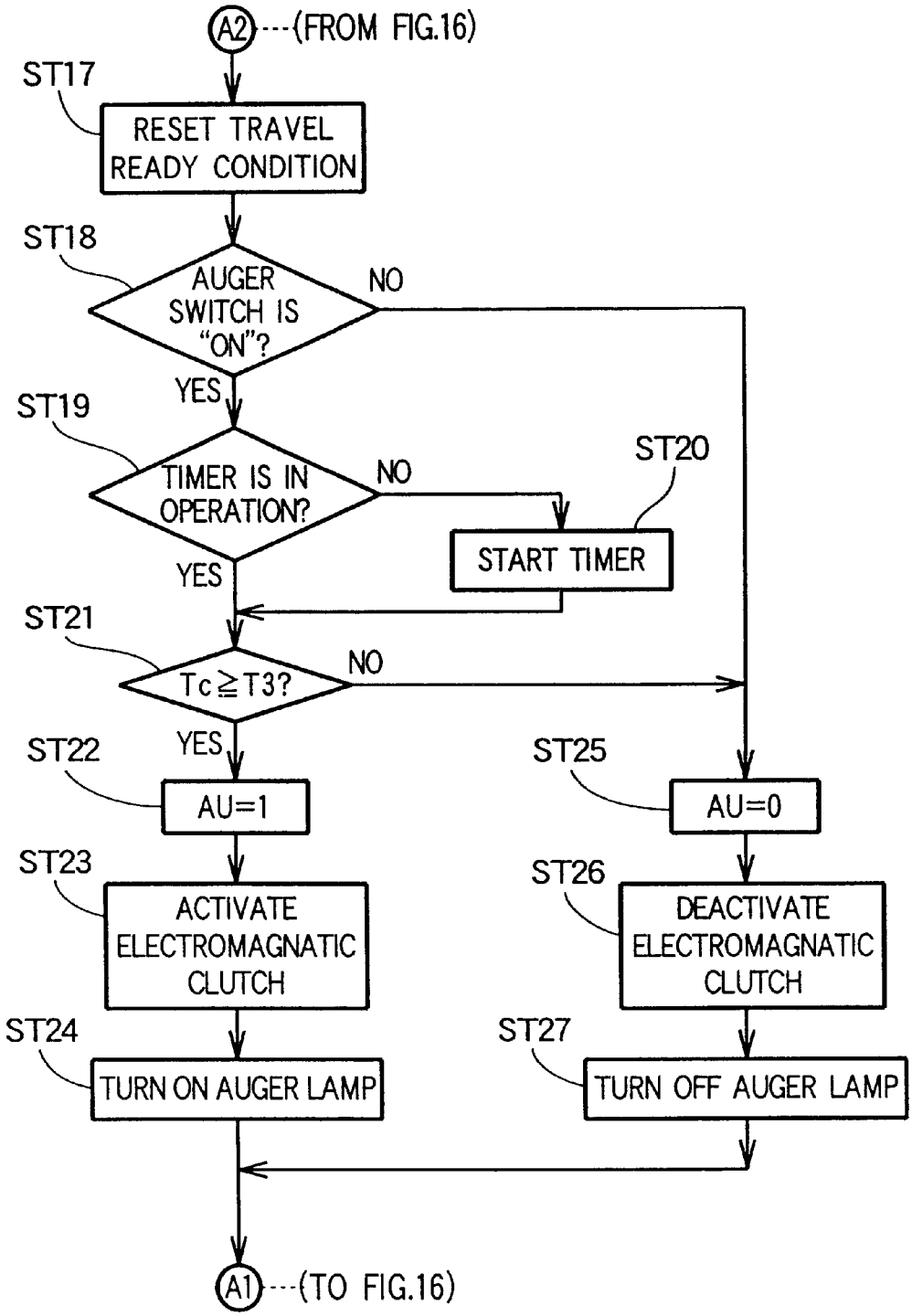
FIG. 17 is a flowchart showing a blanched part of the control procedure.

The control unit 52 may be composed of a microcomputer in which instance the control procedure is carried out in a manner as shown in the flowcharts shown in FIGS. 16 and 17. As shown in FIG. 16, step 01 (ST01) initializes all values. For example, flag AU is set to 0 (AU=0), and the timer is reset. Then, step 02 (ST02) reads data, such as switch signals from the auger switch 46 and the travel ready switch 40. Step 03 (ST03) judges whether or not the travel ready switch 40 is in the ON state. If "YES", this means that the travel ready switch 40 is in the ON state as the travel ready lever 41 is being gripped, and the control procedure advances to step 04 (ST04). If "NO", this means that the travel ready switch 40 is in the OFF state as the travel ready lever 41 has been released, and the control procedure branches to step 17 (ST17) shown in FIG. 17.

Step 04 (ST04) passes judgment that the travel is ready and, and based on this judgment, this step ST04 places the electric motors 21L, 21R in an operative condition. The operative condition means that the electric motors 21L, 21R will start rotation when instructed from the control unit 52 in response to manipulation of the forward/reverse speed control lever 51*c* (FIG. 3). Then, step 05 (ST05) judges whether or not the auger switch 46 is in the ON state. If "YES", this means that the auger switch 46 is in the ON state, and the control procedure advances to step 06 (ST06). If "NO", this means that the auger switch 46 is in the OFF state, and the control procedure returns to step 02 (ST02).

At step 06 (ST06), a judgment is made to determine as to whether the internal timer of the control unit 52 is operating. If the judgment result is "YES", the control procedure goes on to step 08 (ST08). Alternately, if the judgment result at ST06 is "NO", the control procedure branches to step 07 (ST07) where the timer is started after resetting. Step 08 (ST08) judges whether or not AU=0. If "YES", this means that the ON signal from the auger switch 46 is a first ON signal pulse S1, and the control procedure advances to step 09 (ST09). Alternately, if the judgment result at ST05 is "NO", this means that the ON signal from the auger switch 46 is regarded as a second ON signal pulse S2, and the control procedure branches to step 13 (ST13).

At step 09 (ST09), a judgment is made to determine whether or not the count Tc of the timer (i.e., the time period passed after the timer is started) reaches a preset first reference time T1. If the judgment result is "YES", this means that the first ON signal pulse S1 is normal, and the control procedure advances to step 10 (ST10) where the flag is set to 1 (AU=1). Alternately, if the judgment result at ST09 is "NO", this means that the first ON signal pulse S1 is not normal, and the control procedure returns to step 02 (ST02). Step 10 (ST10) is followed by a step 11 (ST11) where the electromagnetic clutch 45 is activated or engaged. Then, step 12 (ST12) turns on the auger lamp 51*k*, and the control procedure returns to step 02 (ST02).

At step 13 (ST13), a judgment is made to determine whether or not the count Tc of the timer (i.e., the time period passed after the timer is started) reaches a preset second reference time T2. If the judgment result is "YES", this means that the second ON signal pulse is normal, and the control procedure advances to step 14 (ST14) where the flag is set to 0 (AU=0). Alternately, if the judgment result at ST13 is "NO", this means that the second ON signal pulse S2 is not normal, and the control procedure returns to step 02 (ST02). Step 14 (ST14) is followed by a step 15 (ST15) where the electromagnetic clutch 45 is deactivated or disengaged. Then, step 16 (ST16) turns off the auger lamp 51*k*, and the control procedure returns to step 02 (ST02).

Referring next to FIG. 17, step 17 (ST17) passes judgment that the travel ready condition of the crawler snowplow is released and, based on this judgment, ST17 places the electric motors 21L, 21R in an inoperative condition. The inoperative condition means that the electric motors 21L, 21R are held immovable (or locked against rotation) even when the forward/reverse speed control lever 51*c* (FIG. 3) is operated. Then, step 18 (ST18) judges whether or not the auger switch 46 is in the ON state. If "YES", the control procedure advances to step 19 (ST19). If "NO", the control procedure branches to step 25 (ST02).

At step 19 (ST06), a judgment is made to determine whether the internal timer of the control unit 52 is operating. If the judgment result is "YES", the control procedure goes on to step 21 (ST21). Alternately, if the judgment result at ST06 is "NO", the control procedure branches to step 20 (ST20) where the timer is started after resetting. Step 21 (ST21) judges whether or not the count Tc of the timer (i.e., the time period passed after the timer is started) reaches a preset third reference time T3. If the judgment result is "YES", this means that the third ON signal pulse S3 is normal, and the control procedure advances to step 22 (ST22) where the flag is set to 1 (Au=1). Alternately, if the judgment result at ST21 is "NO", this means that the third ON signal pulse S3 is not normal, and the control procedure branches to step 25 (ST25).

Step 22 (ST22) is followed by a step 23 (ST23) where the electromagnetic clutch 45 is activated or engaged. Then, step 24 (ST24) turns on the auger lamp 51*k*, and the control procedure returns to step 02 (ST02) shown in FIG. 16. At step 25 shown in FIG. 17, the flag is set to 0 (AU=0) of FIG. 17. Then, step 26 (ST26) deactivates or disengages the electromagnetic clutch 45, and at step 27 (ST27) the auger lamp 51*k* is turned off. The control procedure then returns to step 02 (ST02) shown in FIG. 16.

ST06, ST07, ST09 and ST13 shown in FIG. 16 and ST19, ST20 and ST21 shown in FIG. 17 are not compulsory because these steps are incorporated for the purpose of improving the reliability of auger switch 46.

Figure 18:
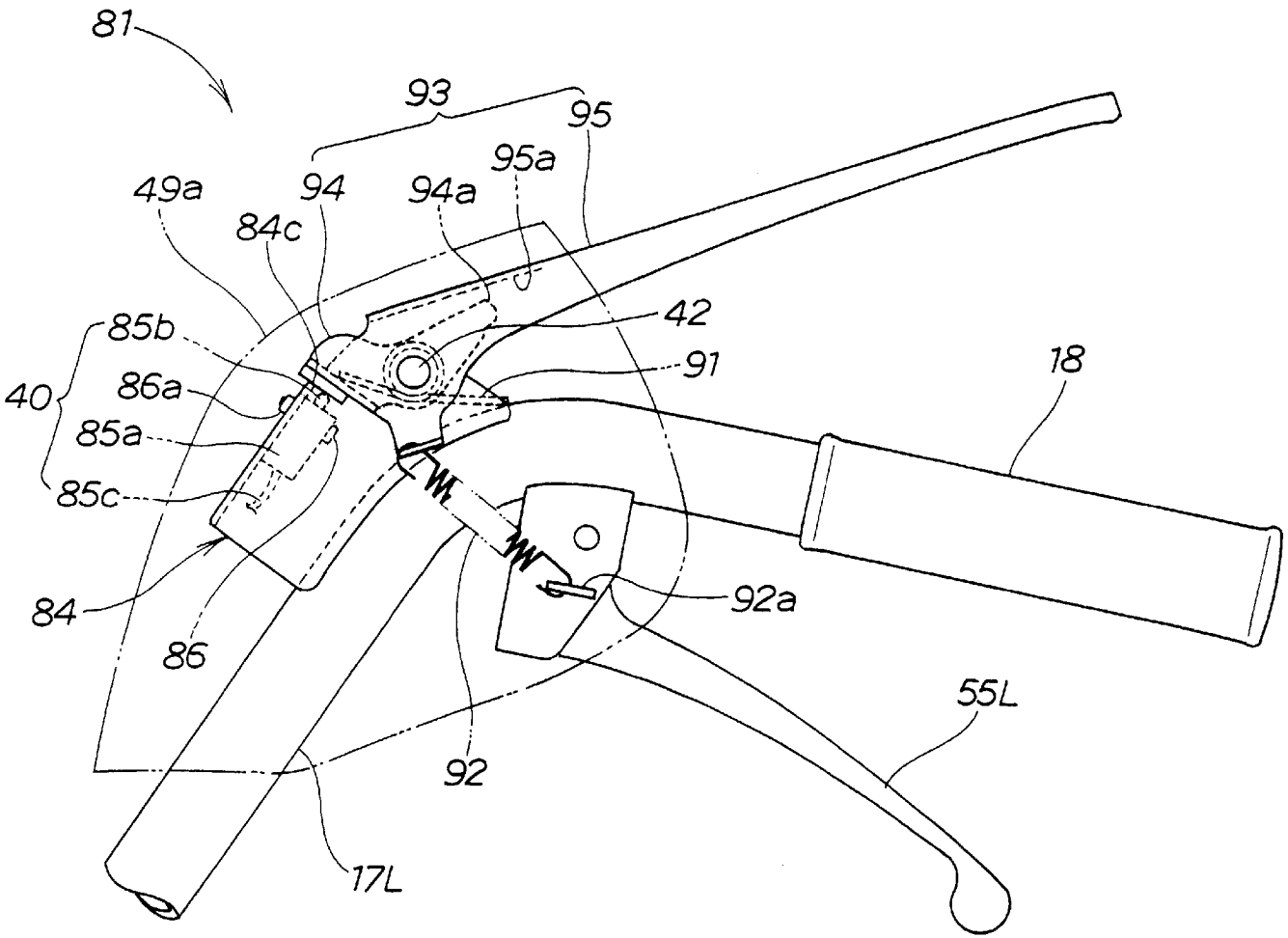
FIG. 18 is a side view showing a switch mechanism according to a modification of the present invention.

FIG. 18 shows a modified form of the switch mechanism shown in FIG. 10. The modified switch mechanism 81 differs from the assembly 80 of FIG. 10 in that a travel ready lever 93 is composed of a lever body 95 of a U-shaped cross section, and a pusher member 94 having an engagement portion 94*a* received in a base portion of the lever body 95. The engagement portion 94*a* is normally spaced or disengaged from the lever body 95. During a forward stroke of its pivotal movement (in the direction toward the handlebar 17L), a portion 95*a* (inside surface of the top wall) of the lever body 95 comes in contact with the engagement portion 94*a* and subsequently forces the engagement portion downward to thereby turn the pusher member 94 clockwise about the pin 42. Since the pusher member 94 is substantially received in the base portion of the lever body 95, the travel ready lever 93 of the modified switch assembly 81 is more compact than the lever 41 of the switch assembly 80 shown in FIG. 10.

Figure 19:
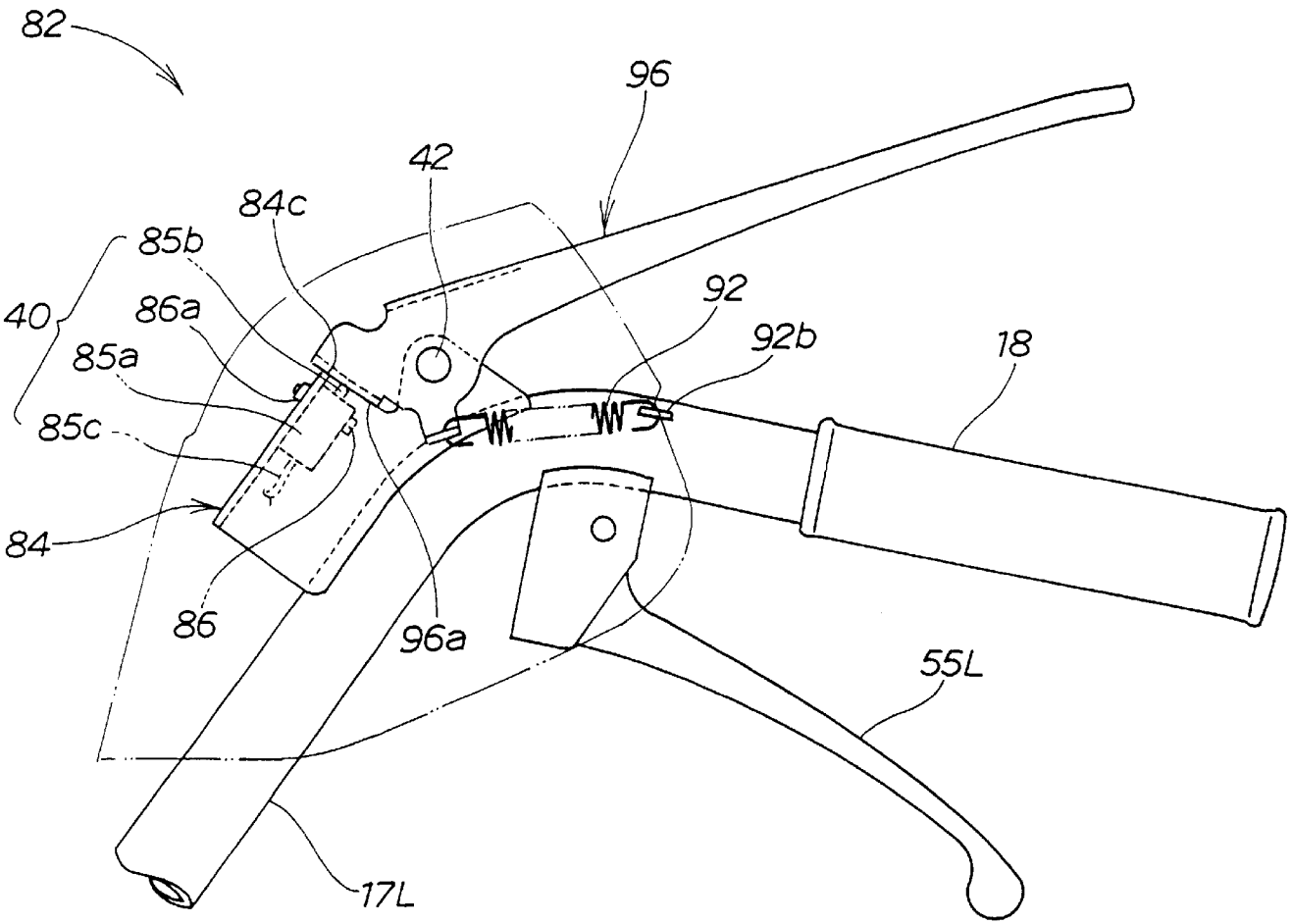
FIG. 19 is a side view showing a switch mechanism according to a further modification of the present invention.
Figure 20A:
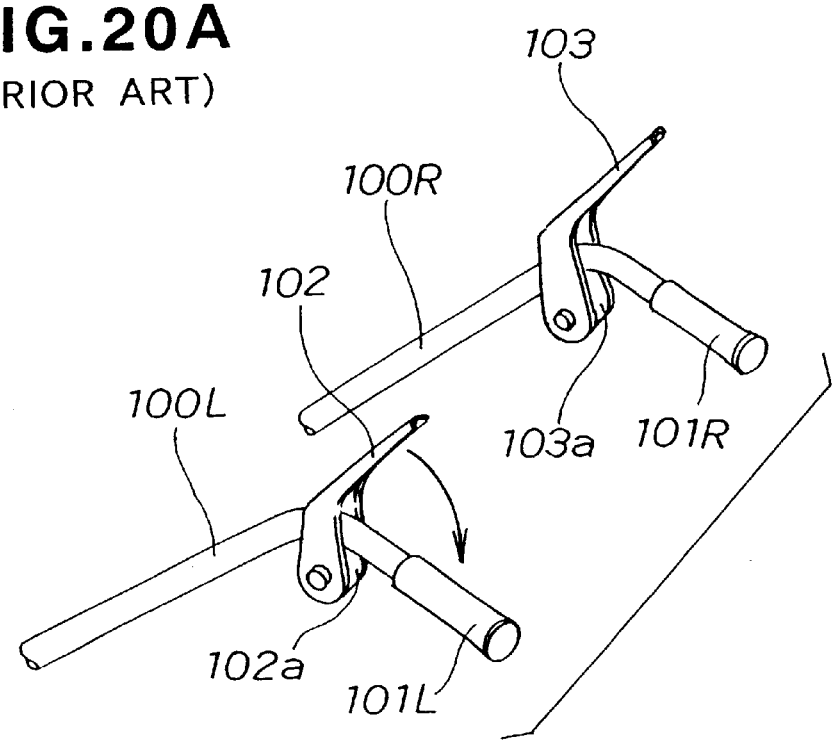
FIG.20A (PRIOR ART)
FIGS. 20A and 20B are perspective views showing the operation of a lever arrangement of a conventional snowplow.
Figure 20B:
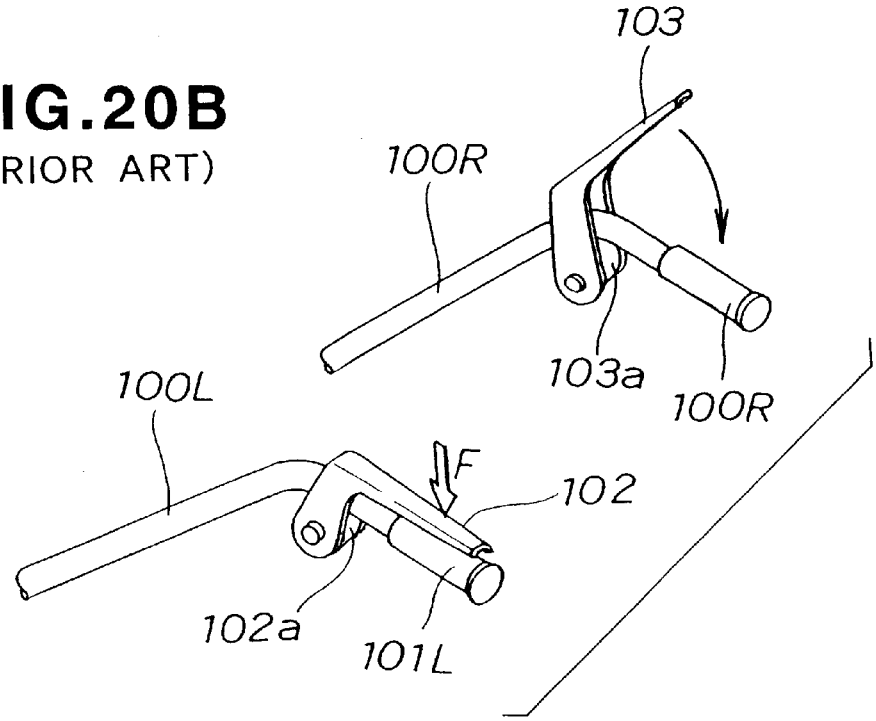
FIG.20B (PRIOR ART)
Figure 21:
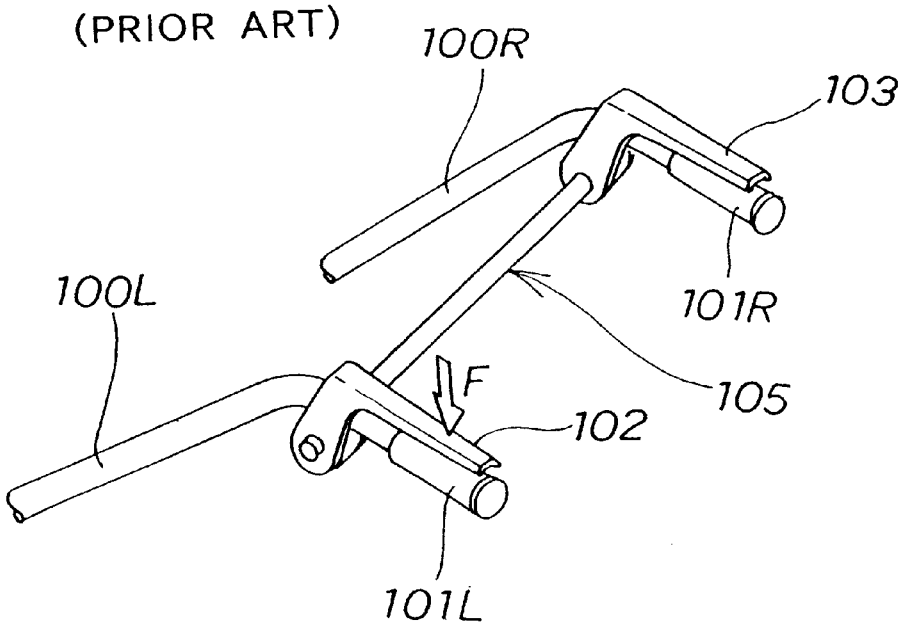
FIG.21 (PRIOR ART)
FIG. 21 is a view similar to FIG. 20, showing another example of the conventional lever arrangement.

FIG. 19 shows another modified form of the switch assembly. The modified switch assembly 82 differs from the assembly 80 shown of FIG. 10 in that a travel ready lever 96 has a one-piece structure and includes pusher part 96*a* formed as an integral part of the base portion of the lever 96. The pusher part 96*a* is disposed on a side opposite to a body of the lever 96 with respect to the pivot pin 42. The pusher part 96*a* has a flat surface extending at an angle to the longitudinal axis of the lever 96. Reference character 92*b* denotes a support lug formed on the handlebar so as to anchor one end of the tension spring 92. When the lever 96 is in the original inoperating position shown in FIG. 19, the pusher part 96*a* is held in abutment with the open end 84*c* of the bracket 84 by the force of the tension spring 92 so that the bracket open end 84*c* is closed and the actuator 85*b* of the switch 40 is held in its retracted position. When gripped by the human operator, the lever 96 pivots clockwise about the pin 42 against the force of the tension spring 92. During that time, the pusher part 96*a* is gradually displaced rightward away from the open end 84*c* of the bracket 84, allowing the actuator 85*b* of the switch 40 to gradually project outward from the bracket open end 84*c*. When the lever 96 reaches its operating position where the lever 96 lies flat on the grip 18, the actuator 85*b* arrives at its projecting position and, hence, the switch 40 is turned on. The on-off timing of the switch 40 can be adjusted by properly setting the angle of inclination of the pusher part 96*a* relative to the longitudinal axis of the lever 96. Since the pusher part 96*a* is formed as an integral part of the lever 96, the switch mechanism 82 has a smaller number of parts than the switch mechanisms 80, 81 shown in FIGS. 10 and 18. This may reduce the manufacturing cost of the switch mechanism 82.

Obviously, various minor changes and modifications of the present invention are possible in the light of the above teaching. It is therefore to be understood that within the scope of the appended claims, the present invention may be practiced otherwise than as specifically described.

The present disclosure relates to the subject matter of Japanese Patent Applications Nos. 2001-123282, 2001-280148, 2001-285690 and 2001-333248, filed Apr. 20, 2001, Sep. 14, 2001, Sep. 19, 2001 and Oct. 30, 2001, respectively, the disclosures of which are expressly incorporated herein by reference in their entirety.

What is claimed is:

1. A walk behind self-propelled snowplow comprising:

a vehicle body;

at least one driving wheel mounted on the vehicle body for propelling the snowplow;

a first power transmitting mechanism;

an electric motor that drives the driving wheel via the first power transmission mechanism;

a snow-removing auger mounted on the vehicle body;

a second power transmission mechanism;

a power source that drives the auger via the second power transmission mechanism;

an electromagnetic clutch incorporated in the second power transmission mechanism for the connection and disconnection of the power source and the auger;

left and right handlebars extending from a rear end of the vehicle body in a rearward direction of the snowplow;

a control board disposed between the left and right handlebars;

a travel ready lever mounted to one of the left and right handlebars and adapted to be gripped by a human operator to place the electric motor in an operative condition; and a clutch control pushbutton switch disposed on the control board at a position close to the other handlebar, the clutch control pushbutton switch being adapted to be manually operated to actuate the electromagnetic clutch.

2. The walk behind self-propelled snowplow according to claim 1, wherein the first power transmission mechanism includes an electromagnetic brake, and the travel ready lever comprises a brake control lever operatively connected to the electromagnetic brake in such a manner that when the brake control lever and the one handlebar are gripped together by the human operator, the electromagnetic brake is released to thereby allow power from the electric motor to be transmitted to the driving wheel.

3. The walk behind self-propelled snowplow according to claim 2, further including a brake control switch operatively connected to the electromagnetic brake and adapted to be actuated by the brake control lever to disengage the electromagnetic brake when the brake control lever and the one handlebar are gripped together by the human operator.

4. The walk behind self-propelled snowplow according to claim 3, further including a power supply for supplying electric power to the electromagnetic clutch and the electromagnetic brake, wherein the clutch control pushbutton switch is connected to the power supply via the brake control switch.

5. The walk behind self-propelled snowplow according to claim 1, wherein the clutch control pushbutton switch and the travel ready lever are operationally linked with each other.

6. The walk behind self-propelled snowplow according to claim 5, further including a travel ready switch adapted to be actuated by the travel ready lever to place the electric motor in the operative condition, wherein the clutch control pushbutton switch is electrically connected with the ravel ready switch.

7. The walk behind self-propelled snowplow according to claim 6, wherein the electromagnetic clutch and the travel ready lever are operatively connected together via the travel ready switch and the clutch control pushbutton switch in such a manner that the electromagnetic clutch is engaged and disengaged when the clutch control pushbutton switch is actuated while the travel ready lever is being gripped together with the one handlebar, the electromagnetic clutch is forcibly disengaged when griping of the travel ready lever is released after the clutch control pushbutton switch is actuated to engage the electromagnetic clutch, and the electromagnetic clutch is engaged and disengaged when clutch control pushbutton switch is actuated while the travel ready lever is released.

8. The walk behind self-propelled snowplow according to claim 1, further including a travel ready switch adapted to be actuated by the travel ready lever to place the electric motor in the operative condition, and a U-shaped bracket attached to the one handlebar so as to define therebetween a hollow space, wherein the travel ready switch has a switch body received in the hollow space of the U-shaped bracket and attached to the bracket, an actuator retractably mounted on the switch body and projecting outward from an open end of the U-shaped bracket, and the travel ready lever has a pusher part normally held in abutment with the open end of the bracket and closing the open end of the bracket while forcing the actuator of the travel ready switch in a retracted position, the pusher part being displaced away from the open end of the bracket to thereby allow the actuator of the travel ready switch to project outward from the open end of the bracket when the travel ready lever is gripped.

9. The walk behind self-propelled snowplow according to claim 8, wherein the pusher part of the travel ready lever is integral with a body of the travel ready lever.

10. The walk behind self-propelled snowplow according to claim 8, wherein the travel ready lever is composed of a lever body and a pusher member pivotally connected with the lever body, the pusher member forming the pusher part, the lever body having an engagement portion normally spaced from the pusher member, the engagement member being engaged with the pusher member to pivot relative to the lever body in a direction away from the open end of the bracket as the lever body approaches the one lever.

11. The walk behind self-propelled snowplow according to claim 8, wherein the open end of the bracket forms a stopper engageable with a part of the travel ready lever to limit a range of pivotal movement of the travel ready lever.

* * * * *